US009631364B2

(12) United States Patent
Dobija

(10) Patent No.: US 9,631,364 B2
(45) Date of Patent: Apr. 25, 2017

(54) WALL PANEL FRAMING SYSTEM

(71) Applicant: Averve, LLC, Laguna Beach, CA (US)

(72) Inventor: Michael Dobija, Laguna Beach, CA (US)

(73) Assignee: Averve, LLC, Laguna Beach, CA (US)

( * ) Notice: Subject to any disclaimer, the term of this patent is extended or adjusted under 35 U.S.C. 154(b) by 0 days.

(21) Appl. No.: 14/322,425

(22) Filed: Jul. 2, 2014

(65) Prior Publication Data

US 2015/0007522 A1 Jan. 8, 2015

Related U.S. Application Data

(60) Provisional application No. 61/842,298, filed on Jul. 2, 2013.

(51) Int. Cl.

| | |
|---|---|
| ***E04F 19/06*** | (2006.01) |
| ***E04B 9/30*** | (2006.01) |
| ***E04B 9/24*** | (2006.01) |
| ***E04B 2/74*** | (2006.01) |
| ***E04F 13/08*** | (2006.01) |
| *E04B 2/76* | (2006.01) |
| *E04B 2/78* | (2006.01) |

(52) U.S. Cl.

CPC ..... *E04B 9/30* (2013.01); *E04B 2/7453* (2013.01); *E04B 9/245* (2013.01); *E04F 13/083* (2013.01); *E04F 13/0817* (2013.01); *E04F 13/0891* (2013.01); *E04B 2/765* (2013.01); *E04B 2/7854* (2013.01); *E04B 2002/7461* (2013.01)

(58) Field of Classification Search

CPC ..... E04B 3/942; E04B 3/7453; E04B 3/766; E04F 19/06

USPC ..... 52/665, 657, 653.1, 656.2, 656.4

See application file for complete search history.

(56) References Cited

U.S. PATENT DOCUMENTS

| | | | | |
|---|---|---|---|---|
| 2,382,456 A * | 8/1945 | Urbain | E04B 9/245 | 52/506.05 |
| 2,737,266 A * | 3/1956 | Gross | B64C 1/06 | 114/86 |
| 3,445,979 A | 5/1969 | Meyer | | |
| 3,566,561 A * | 3/1971 | Hozer | A47B 96/1466 | 52/127.12 |
| 3,731,447 A * | 5/1973 | Dawdy | E04B 2/7854 | 52/481.2 |
| 3,778,175 A * | 12/1973 | Zimmer | B62D 33/044 | 403/187 |

(Continued)

FOREIGN PATENT DOCUMENTS

| | | |
|---|---|---|
| DE | 19854452 | 5/2007 |

*Primary Examiner* — Rodney Mintz
*Assistant Examiner* — Daniel Kenny
(74) *Attorney, Agent, or Firm* — Knobbe, Martens, Olson & Bear, LLP

(57) ABSTRACT

Structures used for dividing, supporting, disguising and/or cladding, for example, modular wall panel systems can include frame members that can include or be in the form of a rail having a panel engaging portion with a generally planar mounting surface configured to accept at least one fastener, the panel engaging portion including first and second lateral sides on opposite sides of the generally planar mounting surface. First and second channels can include side walls extending generally parallel to the generally planar mounting surface, the first and second channels facing away from each other.

19 Claims, 24 Drawing Sheets

(56) References Cited

U.S. PATENT DOCUMENTS

| | | | | | |
|---|---|---|---|---|---|
| 4,069,638 | A | * | 1/1978 | Hasselqvist | B21C 37/104 403/231 |
| 5,116,161 | A | * | 5/1992 | Faisst | E04B 2/76 296/29 |
| 5,220,759 | A | | 6/1993 | Hossli | |
| 5,252,376 | A | | 10/1993 | Greenberg et al. | |
| 5,575,527 | A | | 11/1996 | Pfister | |
| 5,715,643 | A | * | 2/1998 | Parkinson | B62D 23/005 296/203.01 |
| 5,772,169 | A | | 6/1998 | Blockley | |
| 5,784,847 | A | | 7/1998 | Wiklund | |
| 5,839,240 | A | | 11/1998 | Elsholz et al. | |
| 6,029,413 | A | | 2/2000 | Compas, Jr. | |
| 6,425,218 | B1 | | 7/2002 | Doyon et al. | |
| 6,824,204 | B2 | * | 11/2004 | Gabbianelli | B62D 21/152 296/193.06 |
| 7,472,521 | B2 | | 1/2009 | Bilge | |
| 7,810,294 | B2 | | 10/2010 | Maley et al. | |
| 7,984,593 | B2 | | 7/2011 | Weiser | |
| 7,987,648 | B1 | | 8/2011 | Ryan | |
| 8,205,410 | B2 | | 6/2012 | Stanchfield | |
| 2006/0005486 | A1 | * | 1/2006 | Robinson | A47K 3/008 52/211 |
| 2010/0326585 | A1 | | 12/2010 | Wood | |

* cited by examiner

CHASE CAVITY PARTITION

MERCHANDISE FIXTURE

CASEWORK STRUCTURE

ROOM PARTITION

ROOM ENCLOSURE 300
400
500
600
700

CANOPY
300

DROP SOFFIT CHASE CAVITY
500
700
300
500
700

BAFFLE STRUCTURE
300

PERIMETER SOFFIT CHASE CAVITY
700
300
500

UNISET PERIMETER WALL SOFFIT STRUCTURE
BUSSET ALIGNMENT JOINT
700
300
462
464

700
BACKSIDE VIEW
RAILSET EDGE EXTRUSION
700
BUSSET USED AS ALIGNMENT SPLINE FOR HORIZONTAL FRAME ELEMENTS

WALL PANEL FRAMING SYSTEM

TECHNICAL FIELD

The inventions disclosed herein generally relate to systems and components for framed structures that divide, support, surround, disguise and clad multiple variations of end uses, including but without limitation, frames for substrates and decorative finishes which include panels supported by free standing frame or a frame system either directly attached are offset from an existing structure such as a wall, column, plaster, or ceiling deck.

DESCRIPTION OF THE RELATED TECHNOLOGY

Conventional wall panel systems include framing systems for mounting wall panels to existing walls. Some conventional systems mount panels directly to an existing wall and do not allow for adjustment of the distance of the wall panel system from the existing wall nor do they offer much flexibility in the arrangement or method of fixing a panel to an existing wall.

SUMMARY OF THE INVENTIONS

In accordance with some embodiments, a frame can include a rail having a panel engaging portion comprising a generally planar mounting surface configured to accept at least one fastener, the panel engaging portion including first and second lateral sides on opposite sides of the generally planar mounting surface. The frame can also include at least first and second channels, each channel comprising side walls extending generally parallel to the generally planar mounting surface, the first and second channels facing away from each other.

In some embodiments, a wall can include a frame having at least a panel engaging portion comprising a generally planar mounting surface configured to accept at least one fastener, the panel engaging portion including first and second lateral sides on opposite sides of the generally planar mounting surface. Additionally, the wall can also include at least first and second channels, each channel comprising side walls extending generally parallel to the generally planar mounting surface, the first and second channels facing away from each other. A planar member can be connected to and at least partially supported by the frame.

In some embodiments, a method of building a wall can include supporting a first frame member having a panel engaging portion comprising a generally planar mounting surface configured to accept at least one fastener, the panel engaging portion including first and second lateral sides on opposite sides of the generally planar mounting surface and at least first and second channels, each channel comprising side walls extending generally parallel to the generally planar mounting surface, the first and second channels facing away from each other. The method can also include connecting a second frame member to the first frame member, and connecting a panel to at least one of the first and second frame members so as to support the panel above a ground.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION

Figure 1:
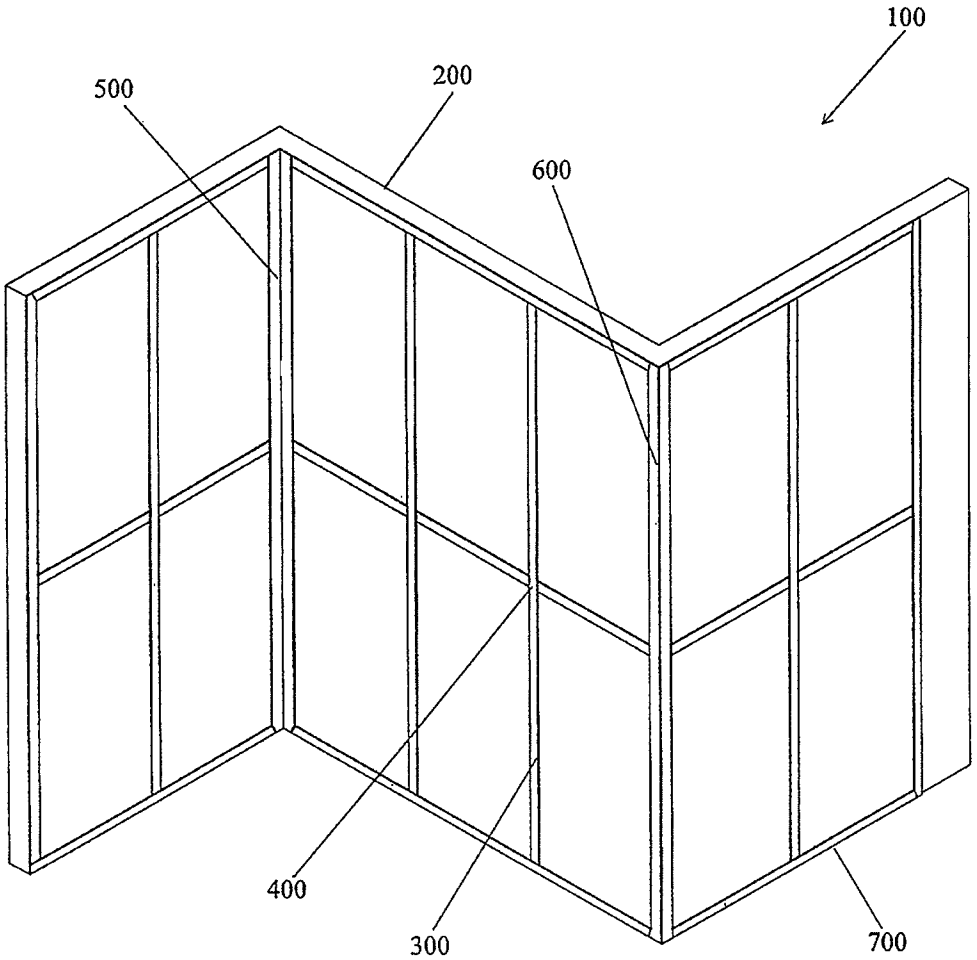
FIG. 1 illustrates an embodiment of a modular wall panel system.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the proceeding technical field, background, brief summary, or the following detailed description.

Certain terminology may be used in the following description for the purpose of reference only, and thus are not intended to be limiting. For example, terms such as "upper", "lower", "above", and "below" refer to directions in the drawings to which reference is made. Terms such as "proximal", "distal", "front", "back", "rear", and "side" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

Additionally, the term "wall" as used herein is intended to refer to any structure that provides a barrier, whether it be flat or curved, stepped or has a different shape. Additionally, the term wall, and some contexts, refers to an individual structural feature such as sides of a channel, in other contexts refers to a portion of a structure formed with any of the frames noted below, and in other contexts, refers to a wall of a structure such as a residence or commercial property.

Embodiments described herein generally relate to structures that divide, support, disguise and clad a multiple variation of end uses. Some of the embodiments disclosed below are described in the context modular wall panel systems because some of the inventions disclosed herein have particular utility in that environment of use. However, the inventions disclosed herein can be used in many other contexts, such as, but without limitation, ceiling, fixtures, caseworks, soffits, exhibits, furniture, etc.

Figure 2:
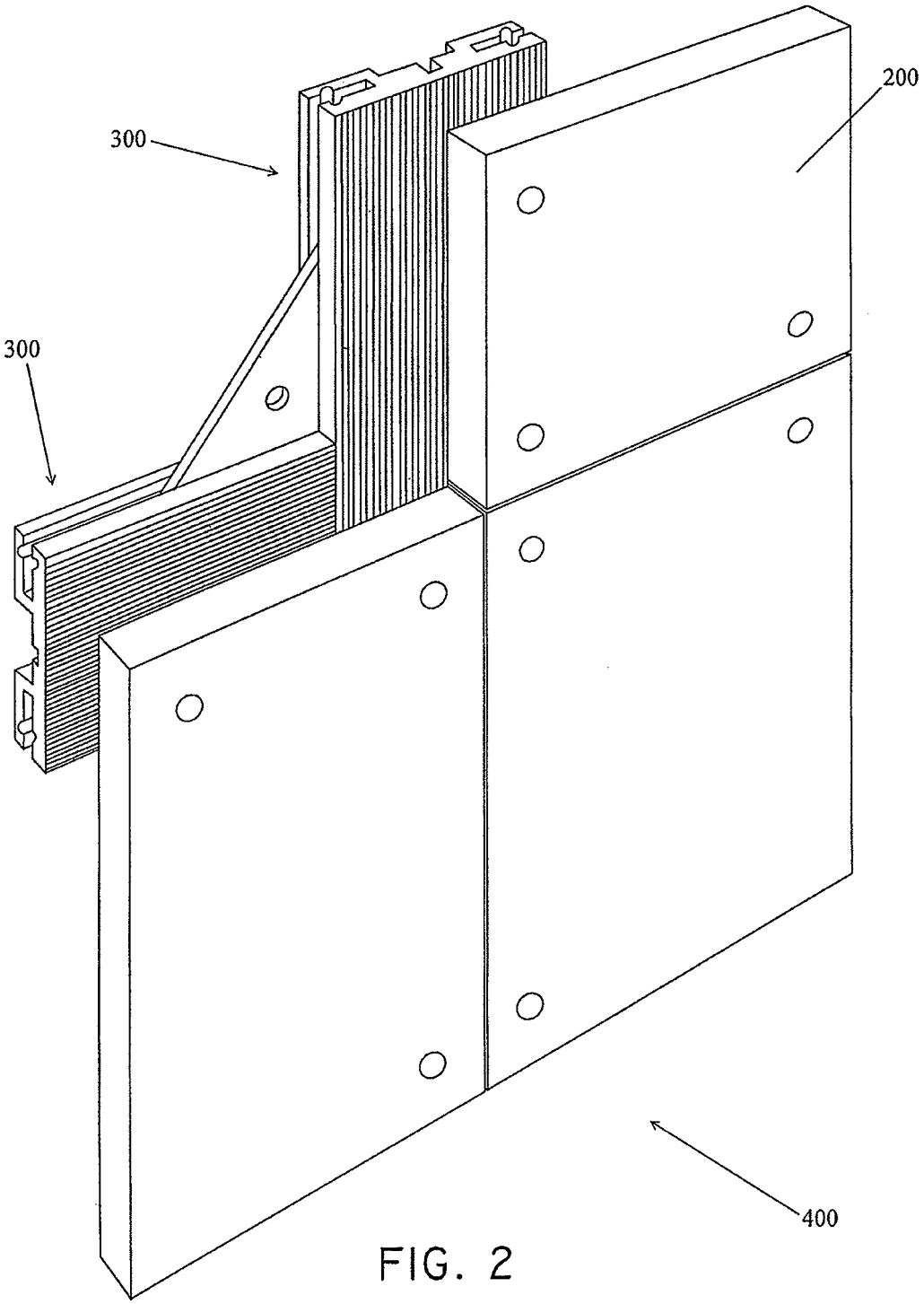
FIG. 2 is a perspective view of an embodiment of a main rail of a panel system with panels installed onto the main rails.

With reference to FIGS. 1 and 2, a framing system 100 can be configured to support panels 200. In some environments of use, the panels can be supported so as to be offset from an existing interior residential or commercial wall or ceiling. Various embodiments of the system 100 described herein can be used to support a variety of panels 200, which may include, for example, substrate materials configured to receive a field finish or decorative panels.

One example of a substrate material is drywall. Examples of a decorative panels include wood veneer and porcelain panels. Other materials can also be used.

In some embodiments, the system 100 can provide a strong, thin, and light weight framing system for a wall. The system 100 can allow a user such as a tenant of a residential or commercial property to change the aesthetic appearance and shape of a room without modifying the existing walls which may be structural and/or may include electrical wires or pipes or other plumbing fixtures.

In addition, some embodiments can provide space between the wall panel system 100 and the existing wall such that the space can be used to accommodate electrical wiring, plumbing, acoustical blanket, lighting, or other materials the tenant may wish to hide from view. In some embodiments, the components of the system 100 can be assembled into a frame only approximately ¾" thick, minimizing overall thickness of the resulting wall and thus minimizing the reduction in the size of the room in which the wall panel system 100 is installed.

FIGS. 1 and 2 illustrate an embodiment of a modular wall panel system 100. In some embodiments, the wall panel system 100 can be configured to support panels 200 which are visible to occupants of the room in which the wall panel system 100 is installed. The wall panel system 100 can include various components which may include, for example, various rails including, for example, main rails 300, outside corner rails 500, inside corner rails 600, and edge rails 700. In some embodiments, rails can be configured to comprise the corner or edge of the wall panel system 100, described in greater detail below with reference to FIG. 7.

In some embodiments, components modular wall panel system 100 can be configured to couple to one another to form a free-standing or supported frame for supporting panels 200 and/or other devices. For example, in addition to supporting panels 200, the modular wall panel system 100 can be configured to couple to an existing wall. In some embodiments, the system 100 can be mounted at ceiling and floor for support with no attachment to penetrate the existing wall surface. In some embodiments, the modular wall panel system 100 can be configured to couple to an existing ceiling and support panels 200 offset (e.g., downwardly) from the ceiling.

FIG. 2 illustrates a perspective view of an assembly of main rails 300 forming a junction 400, with panels 200 installed onto the main rails 300. In some embodiments, as illustrated in FIG. 2, a junction 400 can include the intersection of a rail such as a main rail 300 arranged vertically and another rail, such as another main rail 300, arranged horizontally. A main rail 300 is one type of rail which can be configured to support panels 200, other rails can also be used. In some embodiments, as noted above, rails can be configured to be oriented either vertically or horizontally.

Figure 3:
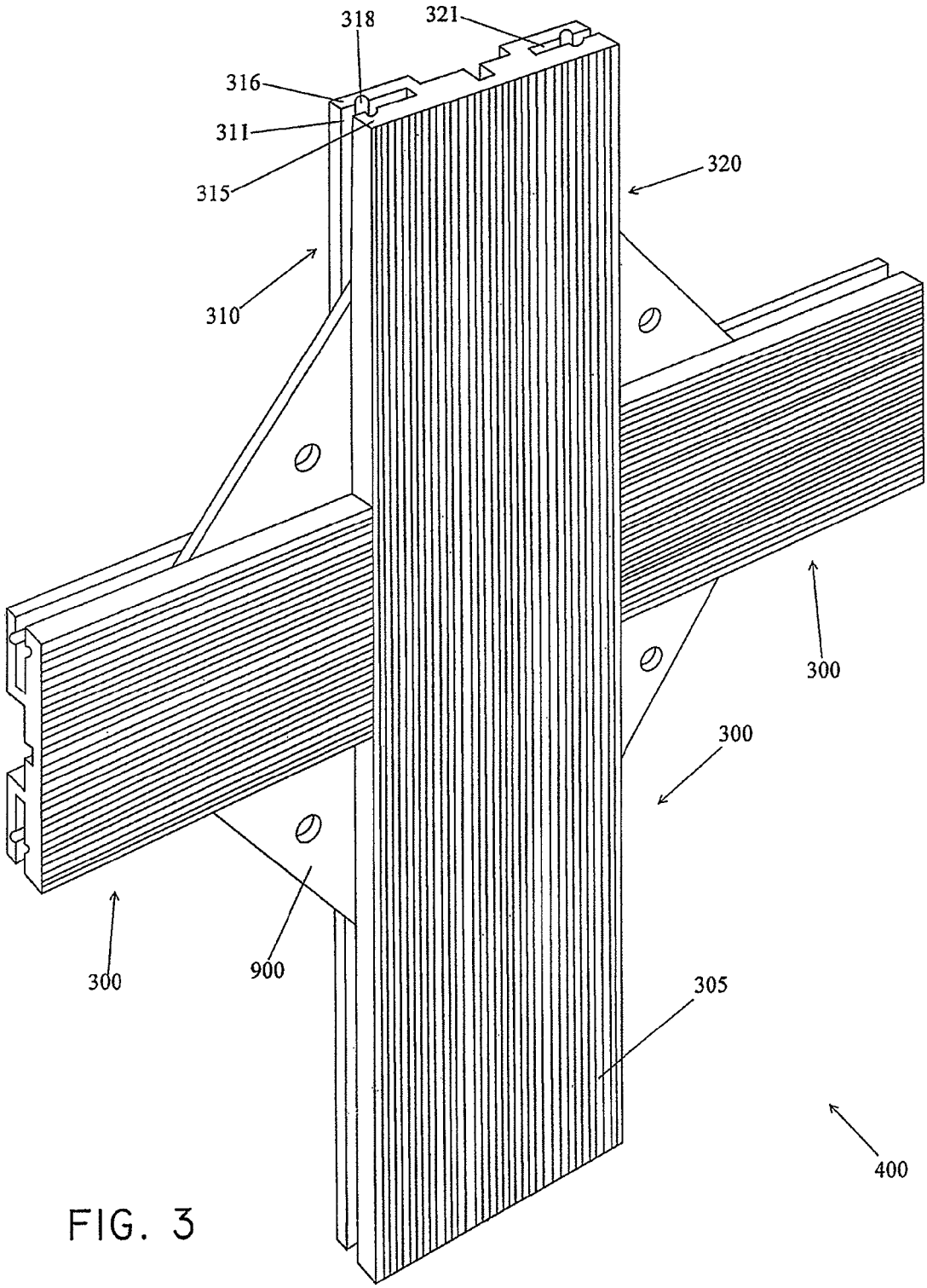
FIG. 3 is a perspective view of a panel engaging side of the main rail of FIG. 2.

FIG. 3 illustrates a perspective view of the panel engaging side of the junction 400 of FIG. 2. In some embodiments, rails can be configured to support panels 200 on the panel engaging side of the rails. In some embodiments, each rail can include a panel engaging portion 305 configured to be engageable for supporting at least one panel 200. The panel engaging portion 305 can be smooth and flat or it can incorporate surface features such as knurls, slots, or other patterns of raised ridges to provide additional engagement with panels 200. In some embodiments, the panel engaging portion 305 can include a generally planar mounting surface configured to accept at least one fastener 800, which can include for example, stainless steel sheet metal self-tapping screws, or other types of fasteners.

In some embodiments, the main rail 300 can be constructed of a material, which may include, for example, aluminum, capable of accepting fasteners 800. In some embodiments, fasteners 800 can be utilized to fasten the panels 200 to the rails. The fasteners can be installed through the panel 200 and into the panel engaging portion 305. In some embodiments, the panel engaging portion 305 can be about 1.5" wide (e.g., in a direction perpendicular to the longitudinal direction of the main rail 300) to mimic the width of a "2×4" stud often used in construction. In other embodiments, different widths can be used to support a variety of panels 200. In some embodiments, the main rails 300 can have generally or substantially uniform cross sections and thus can be made from extruded aluminum. However, main rails 300 formed from extruded aluminum can have some feature that disrupt the generally or substantially uniform cross sections, using post-extrusion machining techniques, such as drilling, milling, cutting, punching, etc. which are well known in the art.

In some embodiments, rails, and as illustrated in FIG. 3, main rails 300, can include a panel engaging portion 305. In some embodiments, main rails 300 can include a first side 310 and a second side 320 on opposite sides of the panel engaging portion 305. In some embodiments, a first side 310 can include a first channel 311 comprising a first sidewall 315 and a second sidewall 316. In some embodiments, the first sidewall 315 and second sidewall 316 can be substantially parallel to the mounting surface of the panel engaging portion 305. In some embodiments, the first sidewall 315 can be a portion of the panel engaging portion 305. In some embodiments, a second side 320 can include a second channel 321 wherein the first channel 311 and second channel 321 are facing away from each other. In some embodiments, the first channel 311 and second channel 321 can be configured to accept additional components of the modular wall panel system 100, which can include, for example, a gusset 900 or an angle 1200, which are configured to couple components of the modular wall panel system 100 together.

In some embodiments, the first channel 311 and second channel 321 can be configured to accept a gusset 900. The gusset 900 can be configured to be couplable to multiple components of the modular wall panel system 100. In some embodiments, a gusset 900 can comprise a piece of sheet metal. In some embodiments, a gusset 900 can be substantially triangular. In some embodiments, a gusset 900 can be configured to slide within a first channel 311 or second channel 321 of a vertically oriented main rail 300 and also within a first channel 311 or second channel 321 of a horizontally oriented main rail 300.

In some embodiments, a gusset 900 can help to maintain a substantially perpendicular relationship between a vertically oriented rail and a horizontally oriented rail. In some embodiments, a gusset 900 can be affixed to a rail via at least one fastener 800. In some embodiments, the first channel 311 or second channel 321 of the rail and the gussets 900 can be configured to have a friction fit when the gusset 900 is inserted into a first channel 311 or second channel 321 of the rail in order to affix the gusset 900 to the rail.

In some embodiments, the first channel 311 and second channel 321 can include a recess 318 formed along the length of each channel 311, 321. In some embodiments, the recess 318 can be partially formed in the first sidewall 315 and the second sidewall 316, forming a recess or detent in both of the sidewalls 315, 316 of the channels 331, 332.

In some embodiments, the recess 318 can be configured to accept a protrusion formed on the surface of another component of the modular wall panel system 100, which can include, for example, a gusset 900, or angle 1200. In some embodiments, gussets 900, angles 1200, or other components of the wall panel system 100 can include protrusions (not illustrated) which are configured to lock the component in place when inserted into a channel 331, 332 of a rail. In some embodiments, the sidewalls 315, 316 of a channel 311, 321 may deflect when the component is inserted into the channel 311, 321, and then return to their default position once the protrusion reaches the bore 318 of the channel 311, 321. In some embodiments, the protrusion can include a bead formed thereon the gusset 900 or angle 1200.

Figure 4:
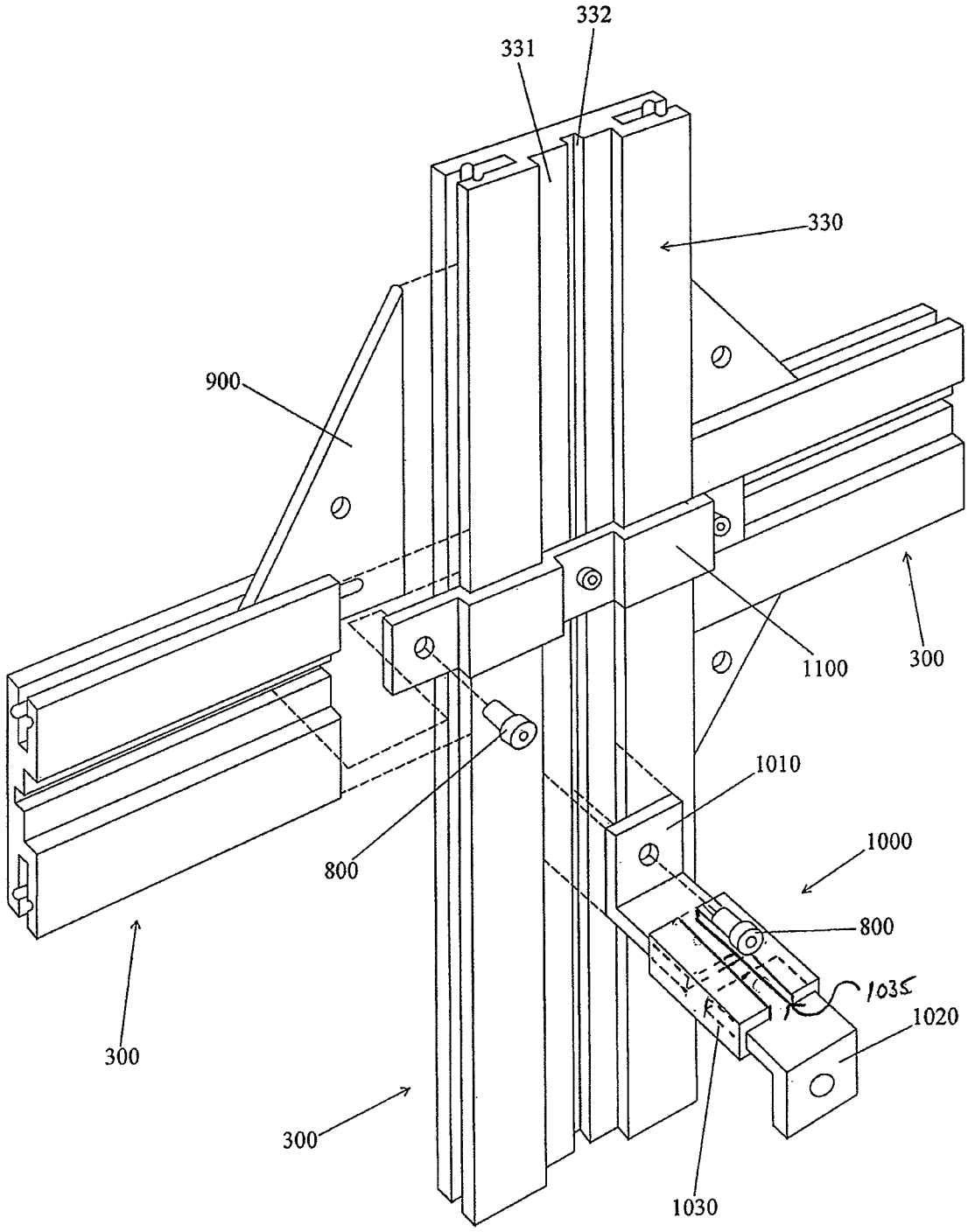
FIG. 4 is a perspective view of the wall engaging side of the main rail of FIG. 2 having a standoff assembly and a bracket.

FIG. 4 illustrates a perspective view of the wall engaging side of the junction 400 of FIG. 2. In some embodiments, rails, and as illustrated in FIG. 4, main rails 300, can include a wall engaging portion 330. In some embodiments, the wall engaging portion 330 can be configured to engage a standoff 1000.

In some embodiments, a standoff 1000 can be configured to couple a rail, such as a main rail 300, to an existing wall. In some embodiments, the standoff 1000 can be configured to be adjustable in length, allowing the installer to change the offset between the rail and the existing wall during installation. The adjustment can allow the installer to gain access behind a partially constructed wall to finish the installation of the system 100. In some embodiments, the standoff 1000 can include means for locking the standoff at a particular offset length. In some embodiments, a fastener can serve as means for locking the standoff 1000 into a desired length.

In some embodiments, a standoff 1000 can include a rail coupling member 1010 configured to couple to the wall engaging portion 330 of the rail. In some embodiments, the rail can include a rear channel 331 formed in the wall engaging portion 330 of the rail. The rail coupling member 1010 can be configured to fit within the rear channel 331 of the rail. The rear channel 331 can be configured to accept the rail coupling member 1010 of the standoff 1000. In some embodiments, the rail coupling member 1010 can be slid within the rear channel 331 until the desired location is achieved.

In some embodiments, a standoff 1000 can also include a wall coupling member 1020. The wall coupling member 1020 can be configured to be coupled to an existing wall. In some embodiments, the wall coupling member 1020 can include at least one aperture configured to accept a fastener 800. In some embodiments, a fastener 800 can be utilized to couple the standoff 1000 to the existing wall.

In some embodiments, a sleeve member 1030 can be configured to accept the ends of the members 1010, 1020 of the standoff 1000, members 1010, 1020 to slide within the receiving portion 1030 so as to allow the distance between the rail and the existing wall to be varied during construction. Optionally, the receiving portion 1030 can include a slot 1035 through which fasteners (not shown) can extend to engage the members 1010, 1020. In some embodiments, a standoff 1000 can be configured to engage two rails instead of a single rail and an existing wall.

As illustrated in FIG. 4, a bracket 1100 can be utilized to couple at least one vertically oriented rail to at least one horizontally oriented rail. For example, a bracket 1100 can couple multiple rails together and add structural integrity to the wall panel system 100. In some embodiments, the bracket 1100 can be configured to engage the wall engaging portion 330 of each rail. In some embodiments, the bracket 1100 can be configured to follow the contours of the wall engaging portion 330 of each rail. In some embodiments, the bracket 1100 can be configured to be coupled to the wall engaging portion 330 of each rail via at least one fastener 800. The bracket 1100 can include at least one aperture to accept a fastener 800. In some embodiments, the width of the bracket 1100 can be optimally dimensioned to fit within the rear channel 331 of a rail.

Figure 5:
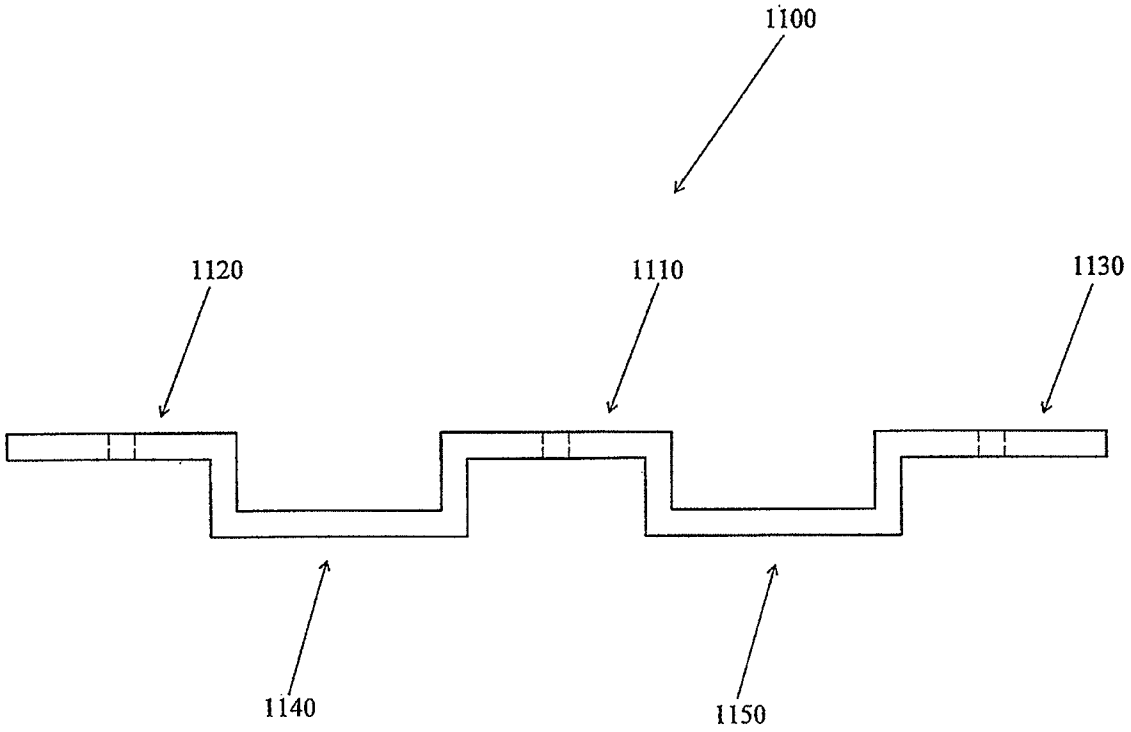
FIG. 5 is a top view of an embodiment of the bracket of FIG. 4.

FIG. 5 illustrates a top view of the bracket of FIG. 4. In some embodiments, the bracket 1100 can include a first rear channel engaging portion 1110 configured to engage the rear channel 331 of a rail. In some embodiments, the bracket can include a second rear channel engaging portion 1120 configured to engage the rear channel 331 of a rail. In some embodiments, the bracket can include a third rear channel engaging portion 1130 configured to engage the rear channel 331 of a rail. In some embodiments, each rear channel engaging portion 1110, 1120, 1130 can be connected via a recessed portion 1140, 1150. In some embodiments, the first channel engaging portion 1110 is connected to the second rear channel engaging portion 1120 via the first recessed portion 1140. In some embodiments, the first channel engaging portion 1110 is connected to the third rear channel engaging portion 1130 via the second recessed portion 1150. In some embodiments, the first, second, and third rear channel engaging portions 1110, 1120, 1130 share a first plane, allowing the bracket 1100 to maintain continuity among the rails it is coupled to and thus maintain a consistent and flat panel engaging surface in order to mount panels 200. In some embodiments, the recessed portions 1140, 1150 are configured to clear portions of the wall engaging portion 330 as illustrated in FIG. 4. In some embodiments, the first and second recessed portions 1140, 1150 share a second plane. In some embodiments, the first plane is offset from the second plane. In some embodiments, the offset between the first and second planes matches the depth of the rear channel 331 of the wall engaging portion 330 of a rail.

Figure 6:
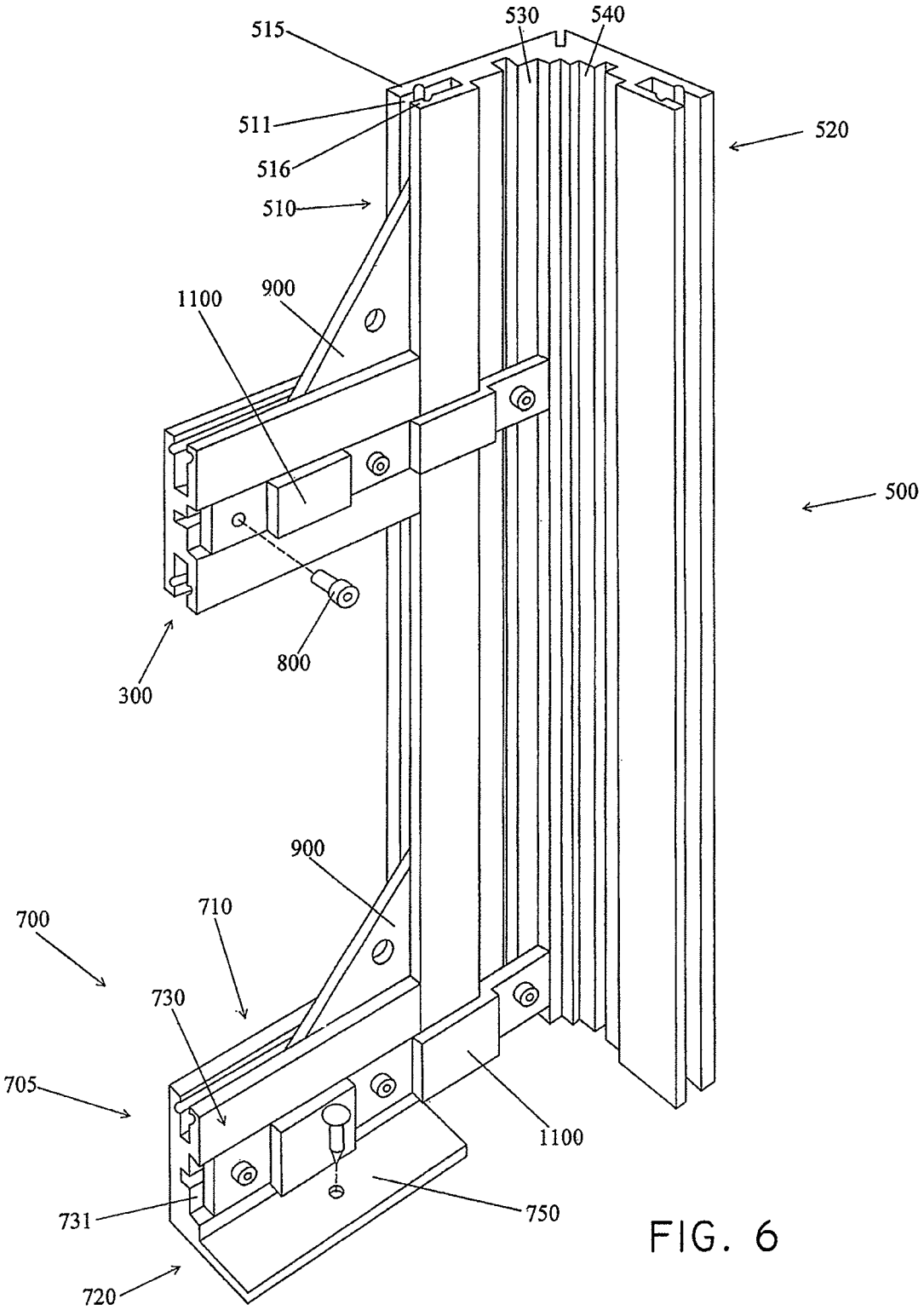
FIG. 6 is a perspective view of an embodiment of an outside corner rail coupled to a main rail and an edge rail.

FIG. 6 illustrates a perspective view of an embodiment of an outside corner rail 500 coupled to a main rail 300 and an edge rail 700. In some embodiments, the modular wall panel system 100 can include a corner rail 500 configured to arrange panels 200 so as to form an "outside corner" of a wall. In some embodiments, the rail can be configured to be positioned at an outside corner where the visible surface of each panel 200 mounted to the rail are splayed away from one another, as illustrated in FIG. 6 and by the outside corner rail 500 of FIG. 1, or an inside corner where the visible surface of each panel 200 mounted to the rail are splayed towards one another, as illustrated by the inside corner rail 600 of FIG. 1. In some embodiments, as illustrated in FIG. 6, the corner rail can be configured to orient panels 200 at a corner angle which may include, for example, approximately 90 degrees, forming a square corner. In some embodiments, the corner rail 500 can include first and second sides 510, 520 as described above, only except the sides 510, 520 are angled relative to one another, and in some embodiments, are perpendicular to one another.

In some embodiments, the corner rail 500 can include first and second channels 511, 521 as described above, only except the channels 511, 521 do not face directly away from each other, but are angled relative to each other, and in some embodiments, are perpendicular to each other. In some embodiments, a corner rail 500 can incorporate first rear channel 530 and a second rear channel 540 similar to the rear channel 331 described above. The first rear channel 530 can be angled relative to the second rear channel 540. In some embodiments, the first rear channel 530 is perpendicular to the second rear channel 540.

In some embodiments, the modular wall panel system 100 can include an edge rail 700 as illustrated in FIG. 6. In some embodiments, the edge rail 700 can include a panel engaging portion 705 (not visible in FIG. 6), a first side 710, a second side 720, and a wall engaging portion 730 including a rear channel 731. In some embodiments, the first side 710 of the edge rail 700 is similar to the first side 310 of the main rail 300 as described above in reference to FIG. 3. In some embodiments, the second side 720 of the edge rail 700 can include a transverse surface engaging portion 750. The transverse surface engaging portion 750 can be configured to couple to a surface, which may include, for example, a floor or a ceiling, which is perpendicular to the panel engaging portion 705 of the edge rail 700. In some embodiments, the transverse surface engaging portion 750 is oriented perpendicular to the panel engaging surface 705 of the edge rail 700. In some embodiments, the transverse surface engaging portion 750 can include at least one aperture configured to accept a fastener 800 to couple the edge rail 700 to a floor, ceiling, or wall.

In some embodiments, the bracket 1100 described above in relation to FIGS. 4 and 5 can be utilized when coupling additional components of the modular wall panel system 100 to a corner rail as well. In some embodiments, due to the configuration of the corner rail, the bracket 1100 can be offset towards the additional component, which may include, for example, a main rail 300 or an edge rail 700. In some embodiments, a different embodiment of the bracket 1100 could be utilized which is designed particularly for use with corner rails. In some embodiments, a corner rail bracket could comprise a first rear channel engaging portion 1110, a second rear channel engaging portion 1120, and a first recessed portion 1140 (not illustrated).

Figure 7:
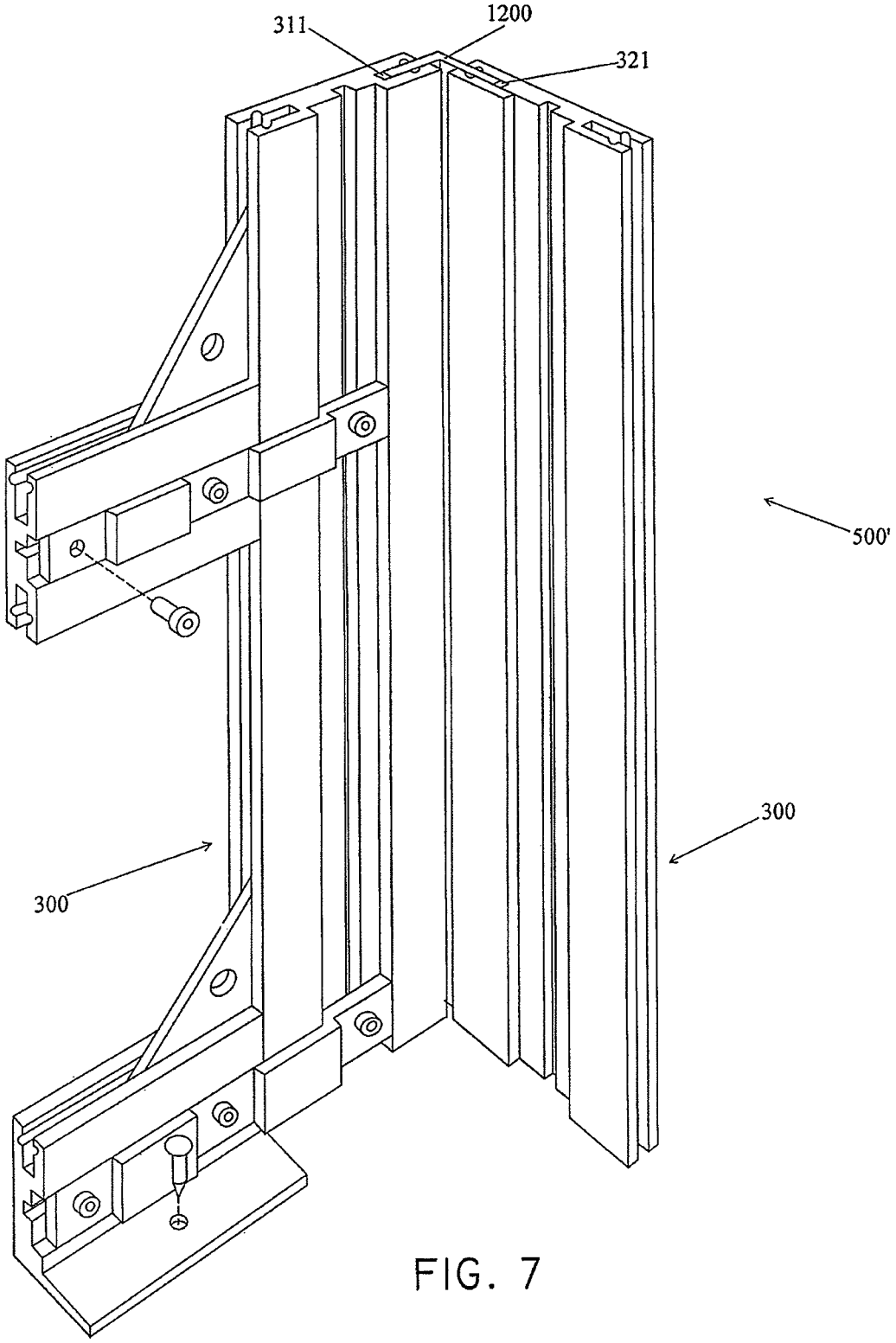
FIG. 7 is a perspective view of an embodiment of a compound main rail outside corner coupled to a main rail and an edge rail.

FIG. 7 illustrates a perspective view of one embodiment of a compound main rail outside corner 500' coupled to a main rail 300 and an edge rail 700. In some embodiments, rather than using a corner rail 500 to arrange panels 200 at a corner of a wall, multiple main rails 300 can be arranged perpendicular to one another and coupled together with an angle 1200 as illustrated in FIG. 7. In some embodiments, the modular wall panel system 100 incorporates an angle 1200. An angle 1200 can be configured to couple multiple rails to one another at a corner. In some embodiments, an angle 1200 can be configured to be inserted into the first channel 311 of one main rail 300 and into the second channel 321 of another main rail 300, coupling the main rails 300 together and maintaining a perpendicular relationship between the main rails 300, forming a compound main rail corner 500'. In some embodiments, the compound main rail corner 500' can comprise an outside corner, as illustrated in FIG. 7 and also similar to the outside corner rail 500 in FIG. 1. In some embodiments, the compound main rail corner 500' can comprise an inside corner, similar to the inside corner rail 600 of FIG. 1. In some embodiments, an angle 1200 can comprise a bent piece of sheet metal. In some embodiments, an angle 1200 can be affixed to a rail via at least one fastener 800. In some embodiments, the first and second channels 311, 321 of the rail and the angle 1200 can be configured to have a friction fit when the angle 1200 is inserted into a first or second channel 311, 321 of the rail in order to affix the angle 1200 to the rail.

In some embodiments, rather than utilizing an edge rail 700 to couple the modular wall panel system 100 to a floor, ceiling, or wall, an angle 1200 can be utilized in the first or second channel 311, 321 of a main rail 300 (not illustrated) to form the equivalent of the transverse surface engaging portion 750 of the edge rail 700 described above in relation to FIG. 6.

Figure 8:
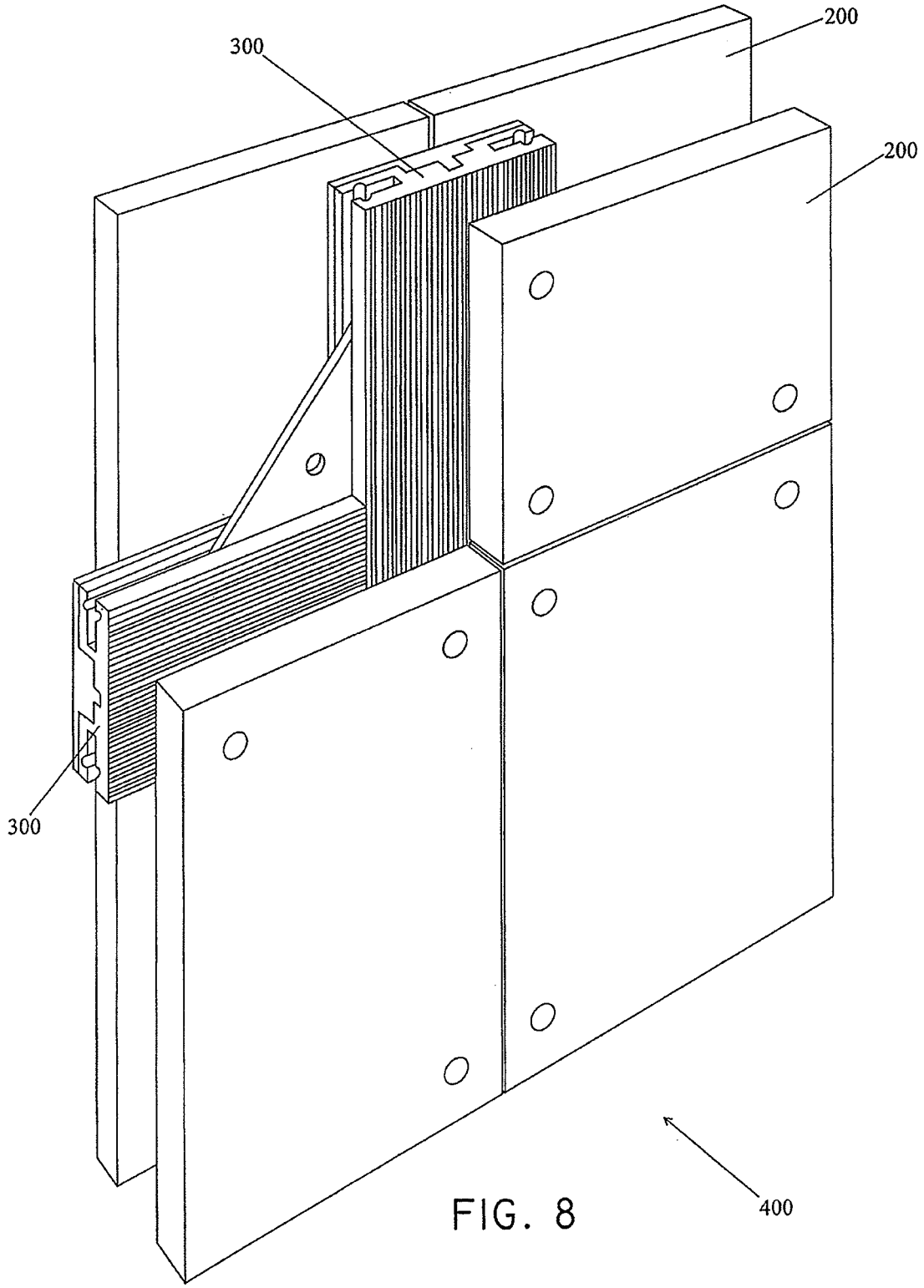
FIG. 8 is a perspective view of a one embodiment of a main rail with panels installed on two sides of the main rails.
Figure 9:
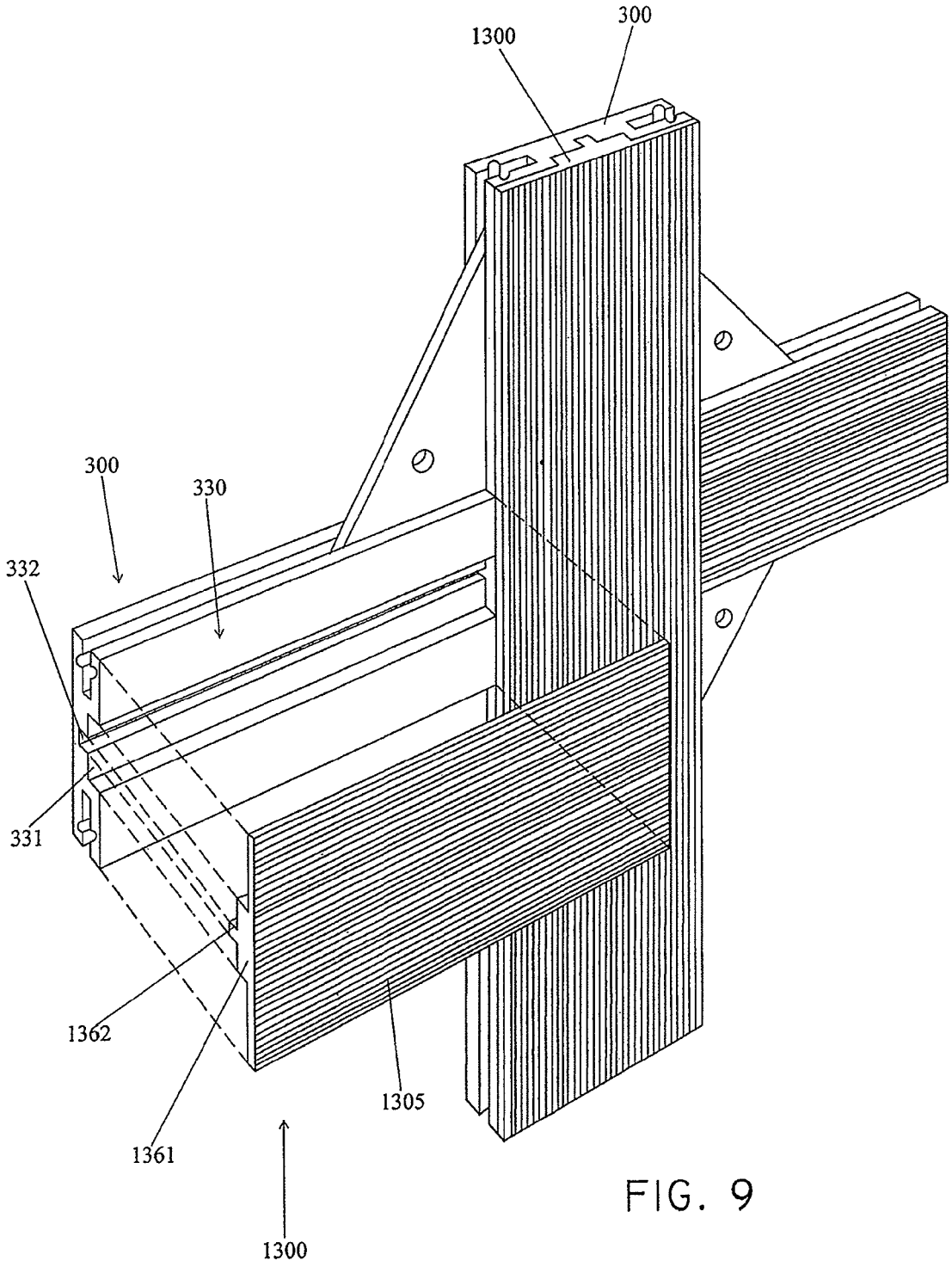
FIG. 9 is a partially exploded perspective view of the main rail of FIG. 8 incorporating rail inserts.

FIG. 8 illustrates a perspective view of a one embodiment of a junction 400 with panels 200 installed on two sides of the main rails 300. FIG. 9 illustrates a partially exploded perspective view of the main rail junction 400 of FIG. 8 incorporating rail inserts 1300. In some situations it may be advantageous to have panels 200 mounted on more than one side of the main rails 300. In some embodiments, the main rails 300 can be configured to engage and support panels 200 on both sides of the main rails 300, as illustrated in FIG. 8. In some embodiments, the modular wall panel system 100 can include a rail insert 1300 configured to be affixed to the wall engaging portion 330 of a main rail 300. In some embodiments, the rail insert 1300 can include a panel engaging portion 1305 configured to engage and support at least one panel 200. In some embodiments, the rail insert 1300 includes a rear channel engaging portion 1361, opposite the panel engaging portion 1305, configured to engage the rear channel 331 of a main rail 300. In some embodiments, the rear channel engaging portion 1361 of the rail insert 1300 can include a sub-channel engaging portion 1362, configured to engage the sub-channel 332 of the main rail 300. In some embodiments, the rear channel engaging portion 1361 and sub-channel engaging portion 1362 can be configured to achieve a friction fit when inserted into the rear channel 331 and sub-channel 332 of a main rail 300. In some embodiments, fasteners 800 can be used to affix the rail insert 1300 to a main rail 300.

Figure 10:
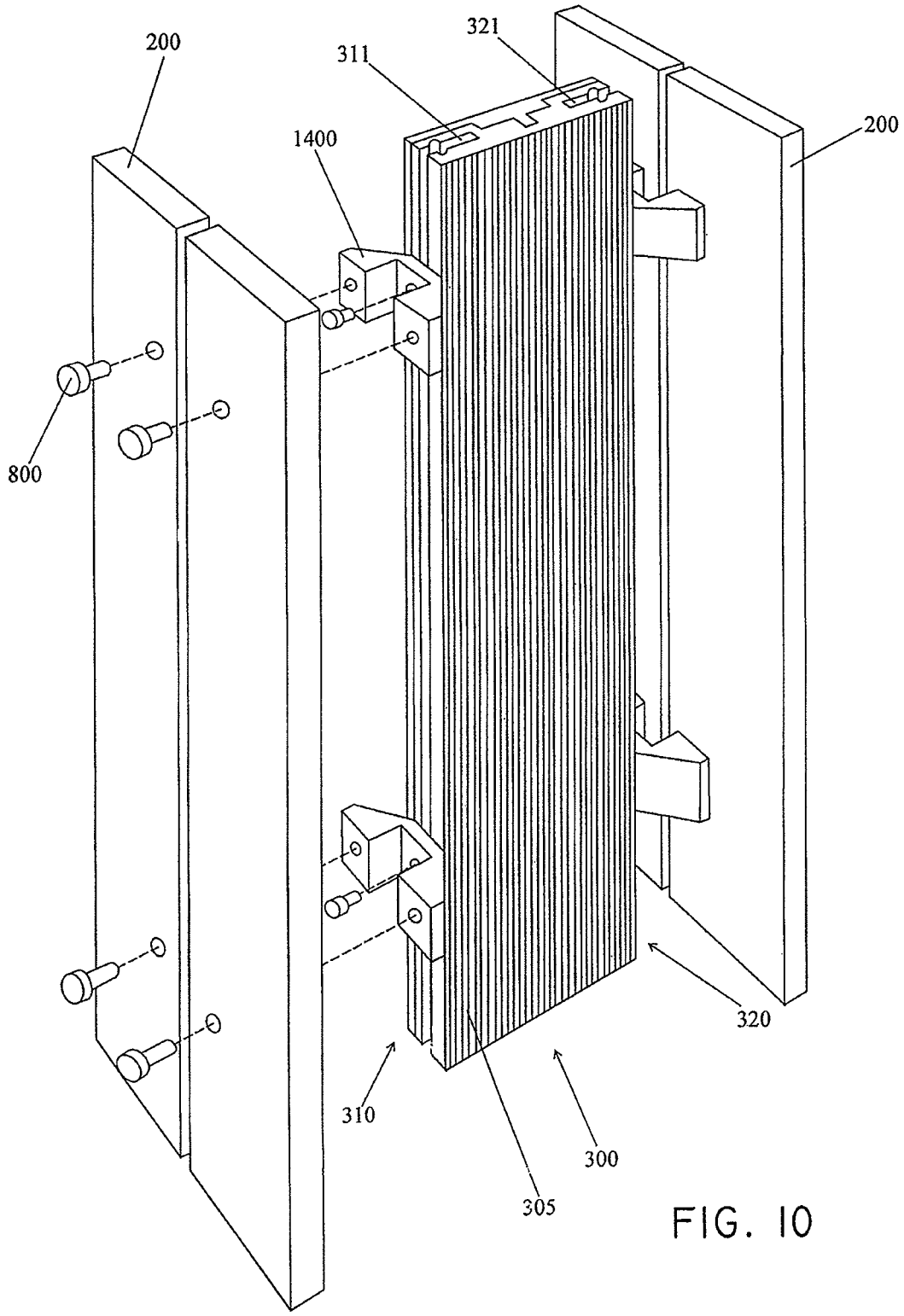
FIG. 10 is a partially exploded perspective view of one embodiment of panels mounted transverse to a main rail.

FIG. 10 illustrates a partially exploded perspective view of one embodiment of panels 200 mounted transverse to a main rail 300. In some situations, it can be advantageous to mount panels 200 perpendicular to the panel engaging portion 305 of a main rail 300. In some embodiments, the modular wall panel system 100 can include an adapter 1400, as illustrated in FIG. 10, to couple at least one panel 200 to a main rail 300 and orient the at least one panel 200 perpendicular to the panel engaging portion 305 of the main rail 300. In some embodiments, the adapter 1400 can include at least one aperture configured to accept a fastener 800. In some embodiments, a fastener 800 can pass through the adapter 1400 and engage the first or second channel 311, 321 of the main rail 300, securing the adapter 1400 to the first or second side 310, 320 of the main rail 300. In some embodiments, an adapter 1400 may be formed integrally in a rail.

Figure 11:
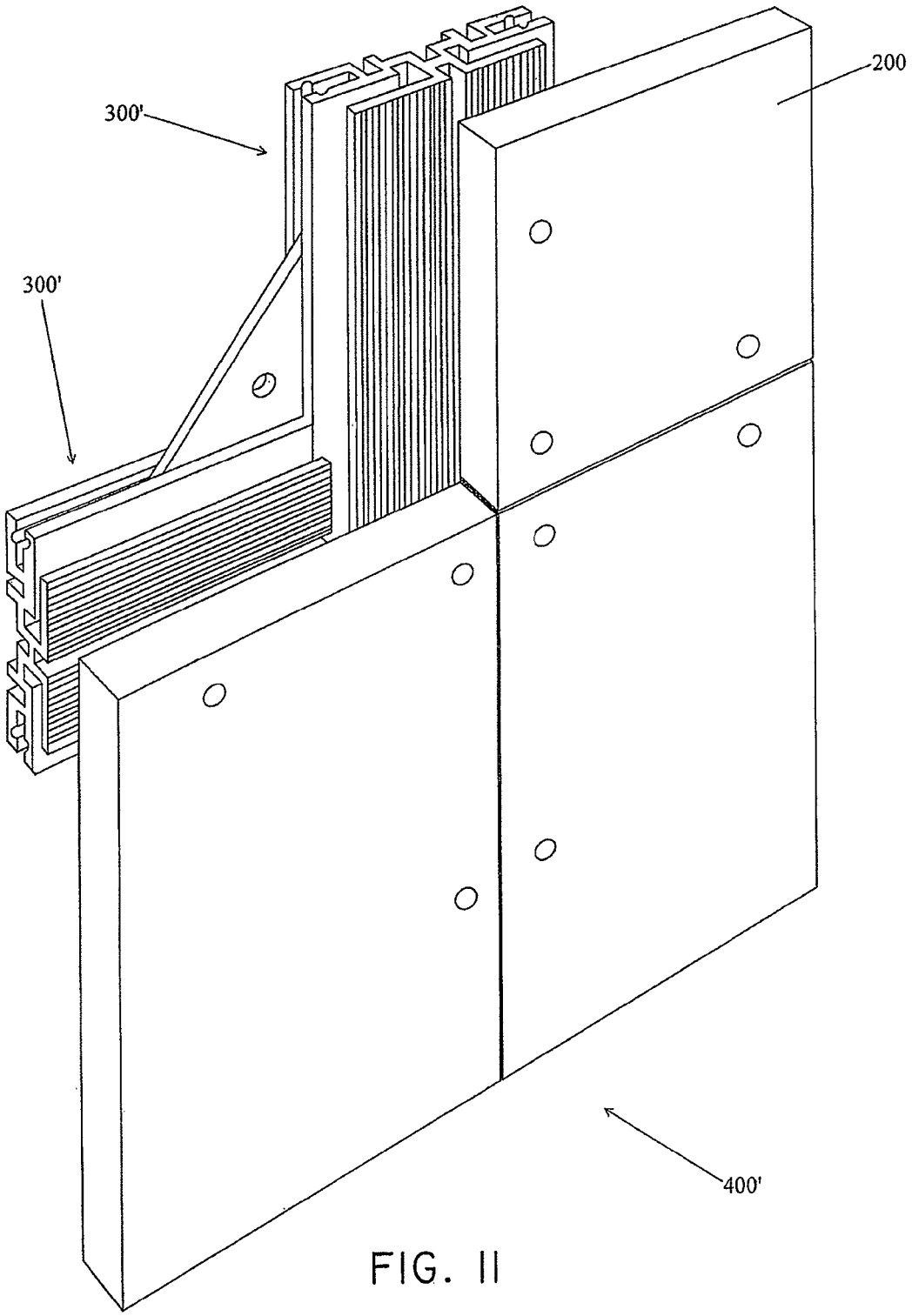
FIG. 11 is a perspective view of another embodiment of a main rail with panels installed onto the main rails.
Figure 12:
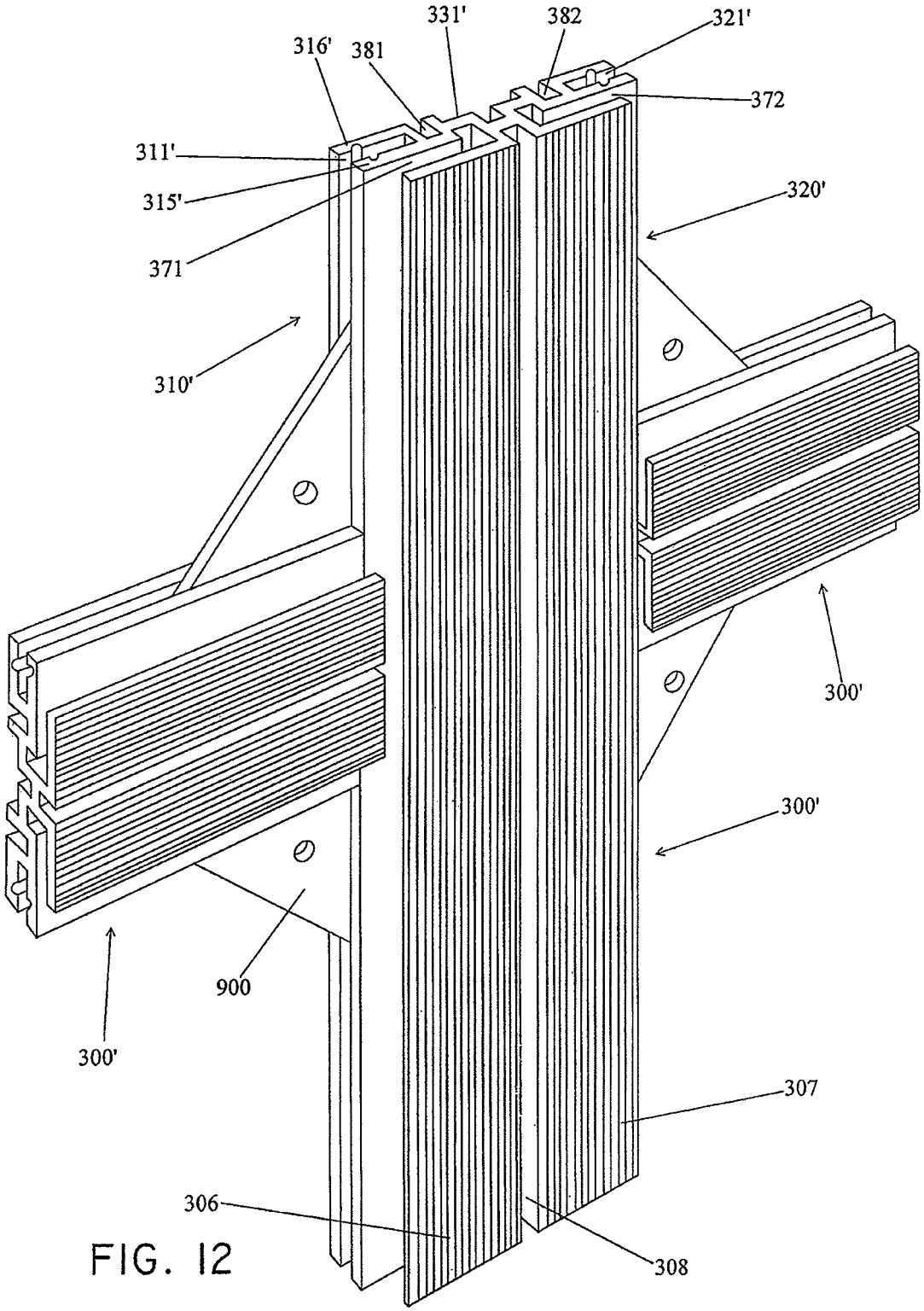
FIG. 12 is a perspective view of the panel engaging side of a slotted main rail.

FIG. 11 illustrates a perspective view of one embodiment of a slotted main rail junction 400' with panels 200 installed onto the slotted main rails 300'. FIG. 12 illustrates a perspective view of the panel engaging side of a slotted main rail junction 400'. In some embodiments, a slotted main rail 300' is an alternative embodiment of the main rail 300 discussed above. In some embodiments, the slotted main rail 300' shares many features with the main rail 300, however some additional features will be discussed below in relation to FIGS. 11-16.

In some embodiments, the slotted main rail 300' can include a first panel engaging portion 306 and a second panel engaging portion 307. In some embodiments, the first panel engaging portion 306 and the second panel engaging portion 307 are located adjacent each other, and separated by a front channel 308. In some embodiments, the slotted main rail 300' can include a first side 310' including a first channel 311', a second side 320' including a second channel 321', and a wall engaging portion 330' (See FIG. 14) including a rear channel 331'. In some embodiments, the slotted main rail 300' can include a first rear offset channel 381 located adjacent the rear channel 331'. In some embodiments, the slotted main rail 300' can include a second rear offset channel 382 located adjacent the rear channel 331'. In some embodiments, the first rear offset channel 381 can be located on a first side of the rear channel 331' and the second rear offset channel 382 can be located on a second side of the rear channel 331'.

In some embodiments, the first or second channel 311', 321' can include a first sidewall 315' and a second sidewall 316'. In some embodiments, the first and second sidewalls 315', 316' can be substantially parallel to the mounting surface of the first and second panel engaging portions 306, 307. In some embodiments, neither the first sidewall 315' nor the second sidewall 316' is a portion of the panel engaging portions 306, 307. In some embodiments, the slotted main rail 300' incorporates a first slot 371 formed in the first side 310' between the first panel engaging portion 306 and the first sidewall 315'. In some embodiments, the slotted main rail 300' incorporates a corresponding second slot 372 in the second side 320'. In some embodiments, the first slot 371 and second slot 372 are parallel to the first and second panel engaging portions 306, 307.

Figure 13:
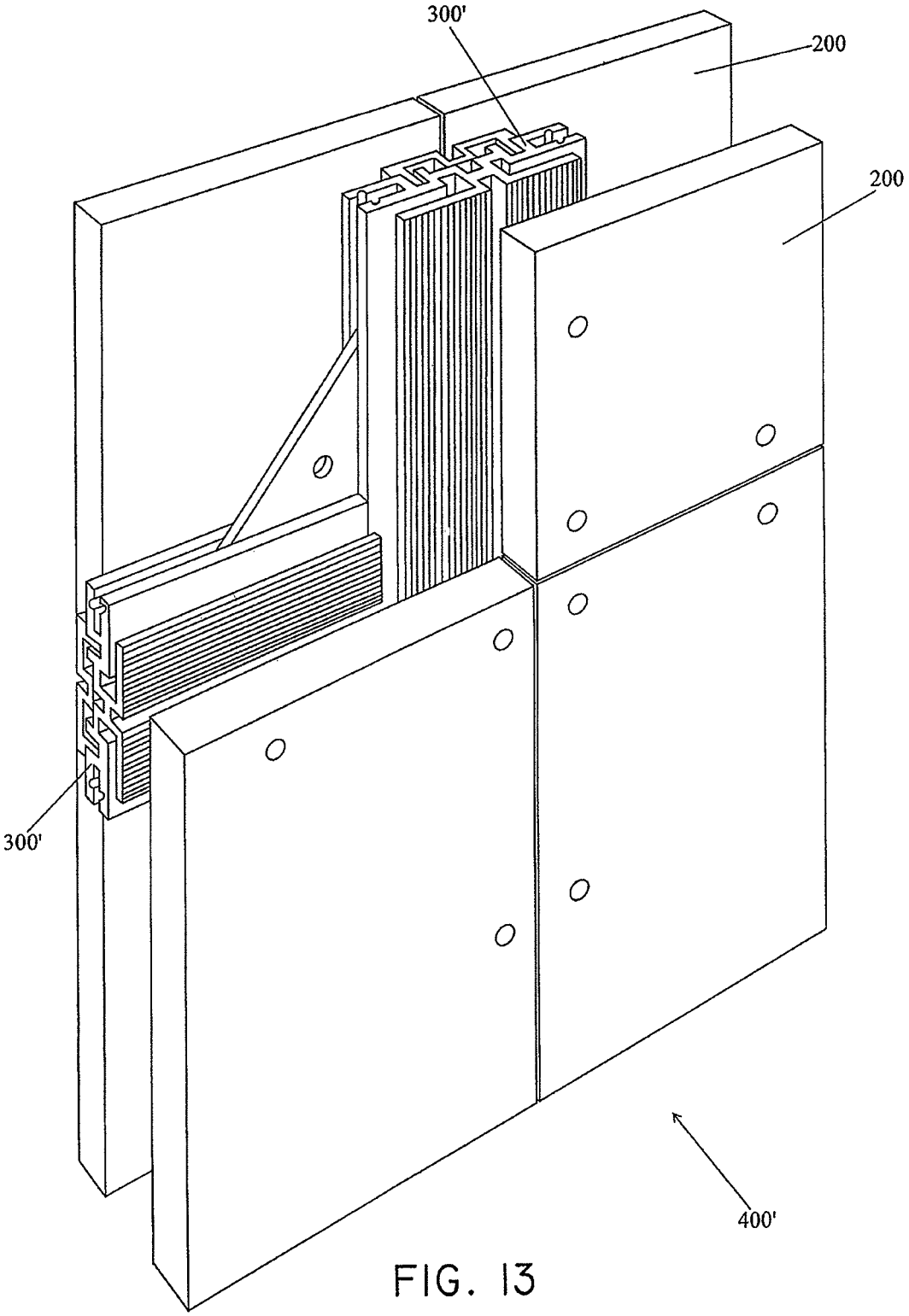
FIG. 13 is a perspective view of the slotted main rail of FIG. 12 with panels installed on two sides of the slotted main rails.
Figure 14:
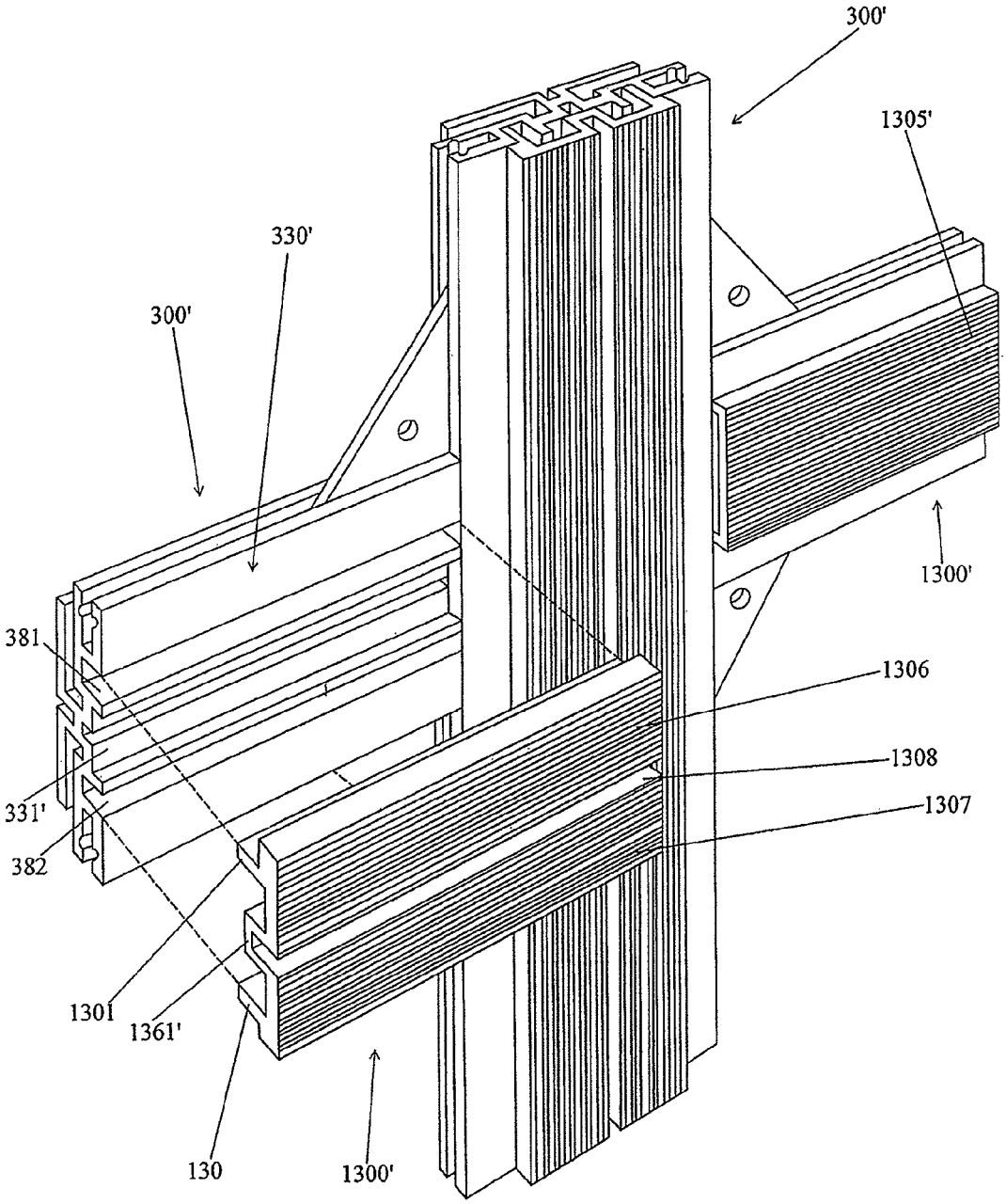
FIG. 14 is a partially exploded perspective view of the slotted main rail of FIG. 12 incorporating slotted rail inserts.

FIG. 13 illustrates a perspective view of the slotted main rail junction 400' of FIG. 12 with panels 200 installed on two sides of the slotted main rails 300'. FIG. 14 illustrates a partially exploded perspective view of the slotted main rail junction 400' of FIG. 12 incorporating slotted rail inserts 1300', 1300". As discussed above, in some situations it may be advantageous to have panels 200 mounted on more than one side of the main rails 300. In some embodiments, the slotted main rails 300' can be configured to engage and support panels 200 on both sides of the slotted main rails 300', as illustrated in FIG. 13. In some embodiments, the modular wall panel system 100 can include a slotted rail insert 1300', 1300" configured to be affixed to the wall engaging portion 330' of a slotted main rail 300'. In some embodiments, the slotted rail insert 1300' can include a panel engaging portion 1305'. In some embodiments, the rail insert 1300" can include a first panel engaging portion 1306 and a second panel engaging portion 1307. In some embodiments, the first panel engaging portion 1306 and the second panel engaging portion 1307 are located adjacent each other, and separated by a front channel 1308. In some embodiments, the slotted rail insert 1300', 1300" includes a rear channel engaging portion 1361', opposite the panel engaging portion 1305', 1306, 1307, configured to engage the rear channel 331' of a slotted main rail 300'. In some embodiments, the slotted rail insert 1300', 1300" can include a first offset channel engaging portion 1301 configured to engage the first rear offset channel 381 of the slotted main rail 300'. In some embodiments, the slotted rail insert 1300', 1300" can include a second offset channel engaging portion 1302 configured to engage the second rear offset channel 382 of the slotted main rail 300'. In some embodiments, the first offset channel engaging portion 1301 can be located on a first side of the rear channel engaging portion 1361' and the second offset channel engaging portion 1302 can be located on a second side of the rear channel engaging portion 1361'. In some embodiments, the first offset channel engaging portion 1301 and the second offset channel engaging portion 1302 can be configured to achieve a friction fit when inserted into the first rear offset channel 381 and second rear offset channel 382 of a slotted main rail 300'. In some embodiments, fasteners 800 can be used to affix the slotted rail insert 1300', 1300" to a slotted main rail 300'.

Figure 15:
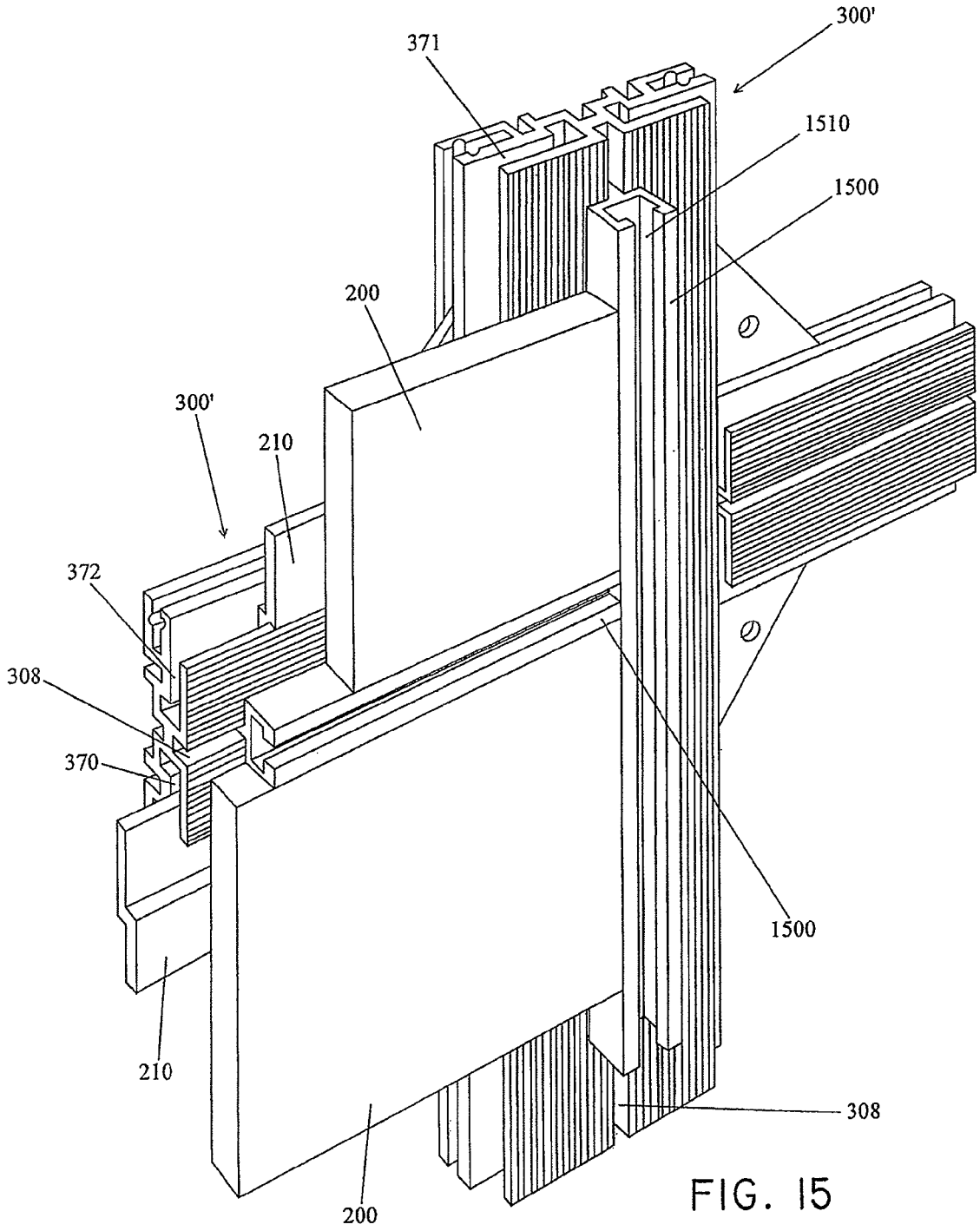
FIG. 15 is a perspective view of a slotted main rail of FIG. 12 with panels incorporating panel clips and battens installed onto the slotted main rails.
Figure 16A:
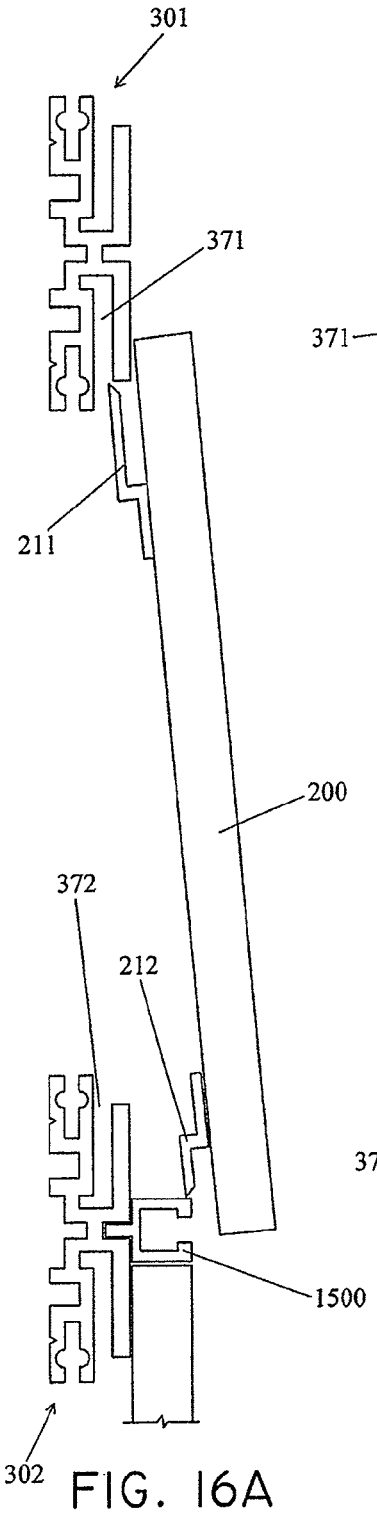
FIG. 16A-C illustrate an optional installation sequence of a panel incorporating panel clips into a pair of slotted main rails.
Figure 16B:
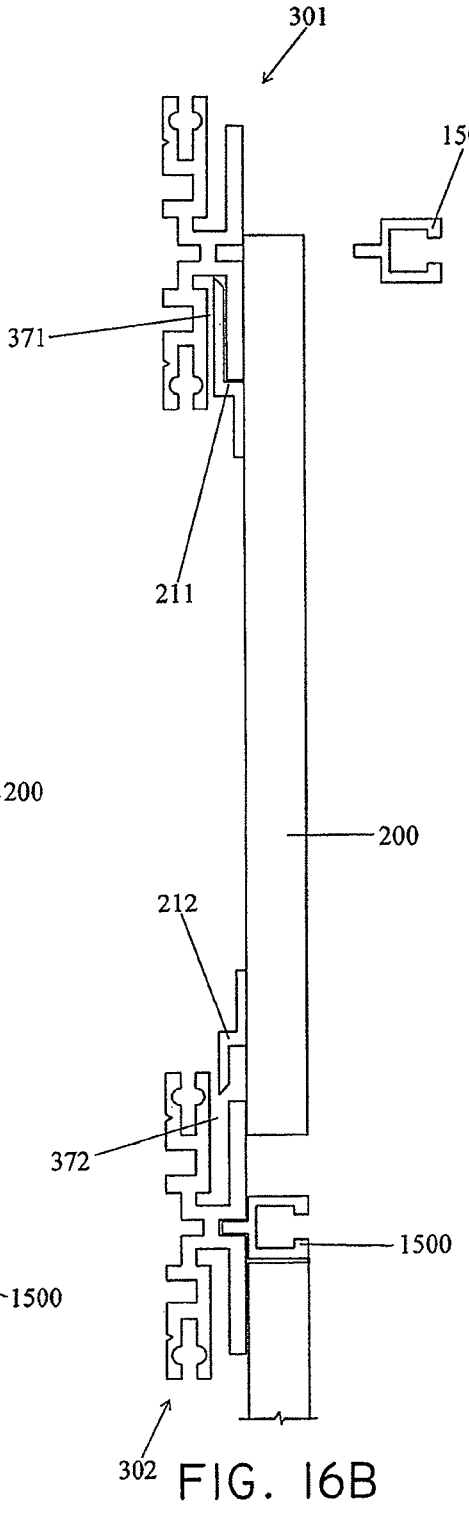
Figure 16C:
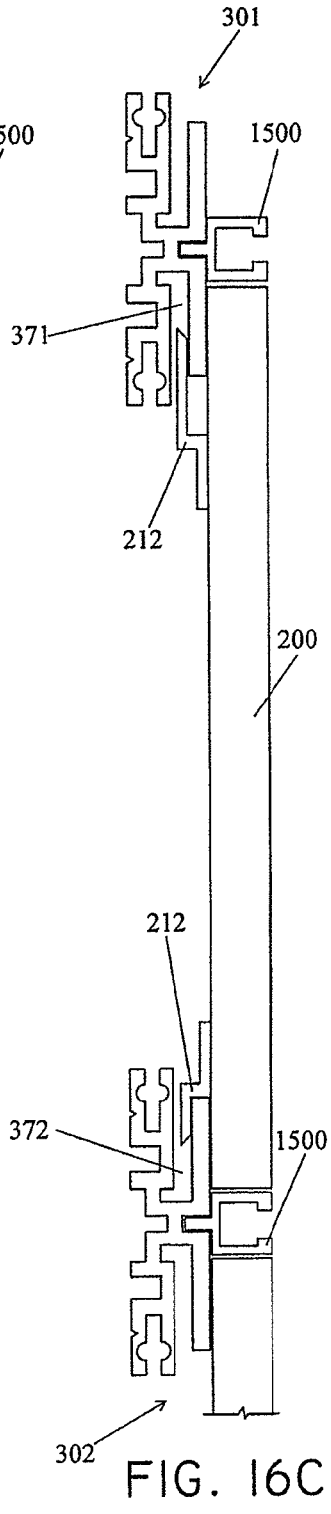

FIG. 15 illustrates a perspective view of the slotted main rail junction 400' of FIG. 12 with panels 200 incorporating panel clips 210 and battens 1500 installed onto the slotted main rails 300'. FIG. 16A-C illustrate the installation sequence of a panel 200 incorporating panel clips 210 into a pair of slotted main rails 300'. In some embodiments, the slots 371, 372 of the slotted main rail 300' can be used to engage and support panels 200, as illustrated in FIG. 15. In some embodiments, the modular wall panel system 100 can include at least one panel clip 210 affixed to a panel 200. In some embodiments, a panel clip 210 can be configured to engage a slot 371, 372 of a slotted main rail 300'. In some embodiments, a panel clip 210 of a panel 200 can be installed in a slot 371, 372 of a slotted main rail oriented vertically. In some embodiments, a panel clip 210 of a panel 200 can be installed in a slot 371, 372 of a slotted main rail 300' oriented horizontally. In some embodiments, the panel clip 210 can be adhered to a panel 200 with an adhesive, avoiding the need to pass a fastener 800 through the panel which can be undesired in certain circumstances which may include, for example, extremely hard or brittle materials as well as panels 200 which are intended to not be disturbed by fasteners for aesthetic reasons.

In some embodiments, the modular wall panel system 100 can include battens 1500 which can be a decorative portion of the system 100. In some embodiments, battens 1500 can be configured to be placed between panels 200. In some embodiments, a portion of the batten 1500 can be configured to be inserted into the front channel 308, 1308 of either a slotted main rail 300' or a slotted rail insert 1300. In some embodiments, the front channel 308, 1308 and batten 1500 can be configured to achieve a friction fit when the batten 1500 is inserted into the front channel 308, 1308. In some embodiments, battens 1500 can be used to restrain panels 200 in position. In some embodiments, battens can restrain the panel clip 210 of a panel 200 from leaving a slot 371, 372 of a slotted main rail 300'. In some embodiments, the battens 1500 can include a batten key channel 1510 configured to accept a batten key (not illustrated), such that a batten key can be inserted into the batten key channel 1510, rotated, and then pulled away from the modular wall panel system 100, releasing the batten 1500 from the modular wall panel system 100.

In some embodiments, a panel can include more than one panel clip, as illustrated in FIG. 16A-C. In some embodiments, the distance between a first slotted main rail 301 and a second slotted main rail 302 and the size and distance between a first panel clip 211 and a second panel clip 212 of a panel 200 can be configured to allow a panel 200 to be coupled to a pair of slotted main rails 301, 302 without moving either of the slotted main rails 301, 302 and without repositioning the panel clips 211, 212 on the panel 200. In some embodiments, as illustrated in FIG. 16A, a first panel clip 211 of a panel 200 can be installed in a first slot 371 of a first slotted main rail 301. In some embodiments, as illustrated in FIG. 16B, the panel 200 can be slid all the way towards the first slotted main rail 301, allowing the second panel clip 212 to clear the second slotted main rail 302. In some embodiments, as illustrated in FIG. 16C, the panel 200 can then be slid towards the second slotted main rail 302, and a batten 1500 installed in the first slotted main rail 301, restraining the panel 200 in place.

Figure 17:
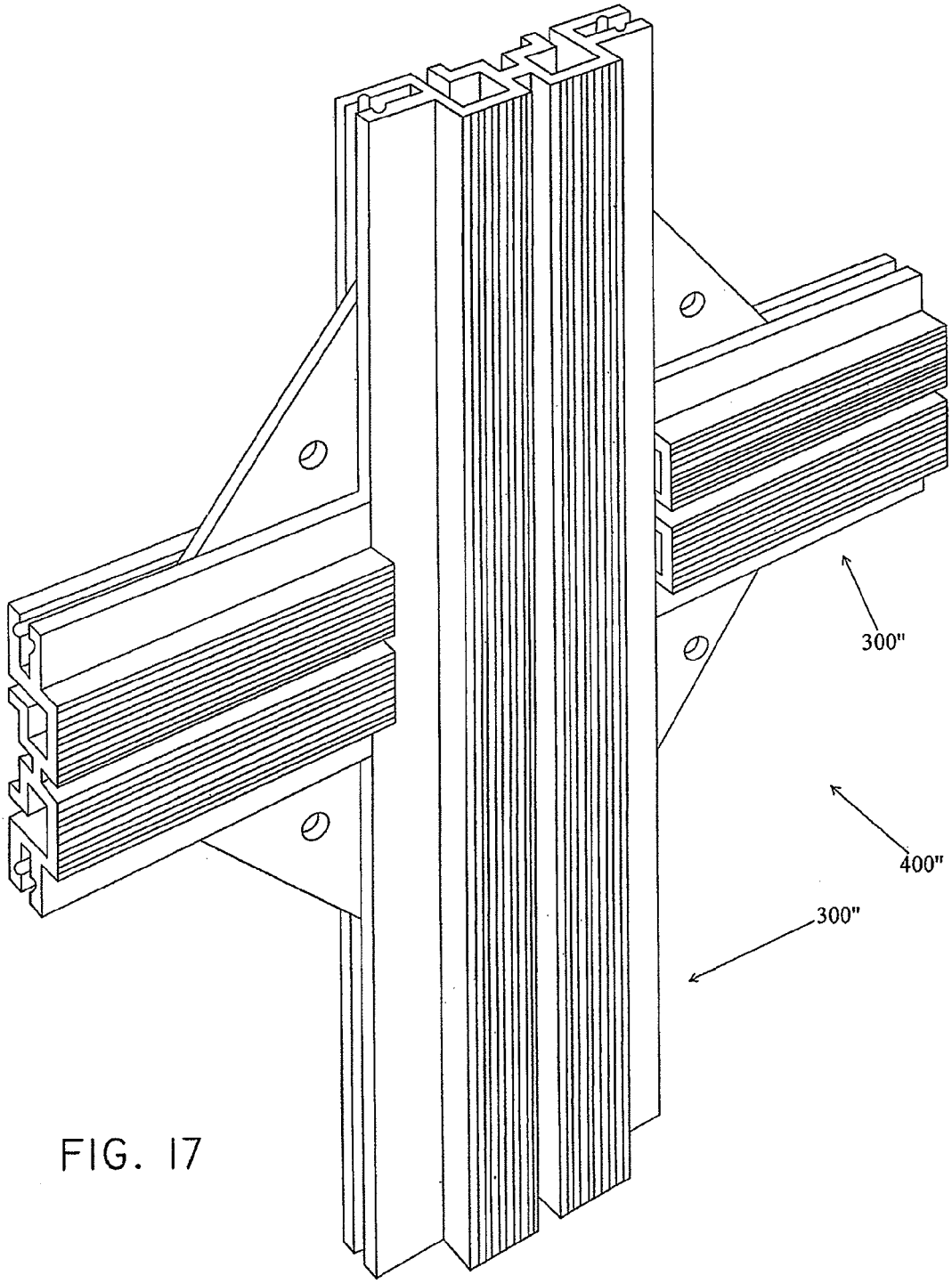
FIG. 17 illustrates a perspective view of another alternative embodiment of a main rail junction.
Figures 18, 19, 20, 21, 22:
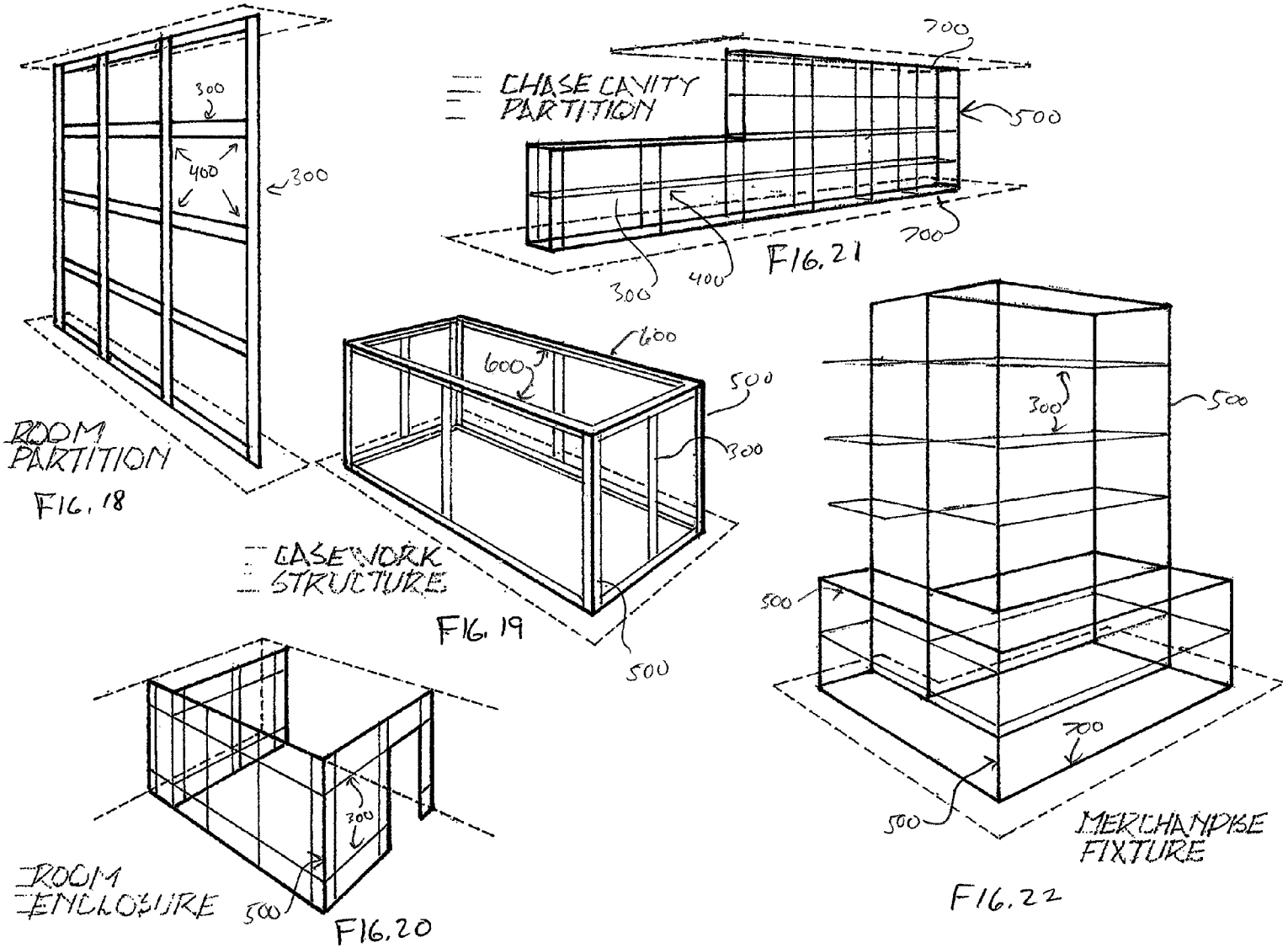
FIG. 18 is a perspective view of a frame for a wall partition that can be formed with any of the embodiments of the main rail and associated components of FIGS. 1-17.
FIG. 19 is a perspective view of a frame of a casework structure that can be formed with any of the embodiments of the main rail and associated components of FIGS. 1-17.
FIG. 20 is a perspective view of a frame of a room enclosure that can be formed with any of the embodiments of the main rail and associated components of FIGS. 1-17.
FIG. 21 is a perspective view of a chase cavity partition that can be formed with any of the embodiments of the main rail and associated components of FIGS. 1-17.
FIG. 22 is a perspective view of a merchandise fixture that can be formed with any of the embodiments of the main rail and associated components of FIGS. 1-17.
Figures 23, 24, 25, 26:
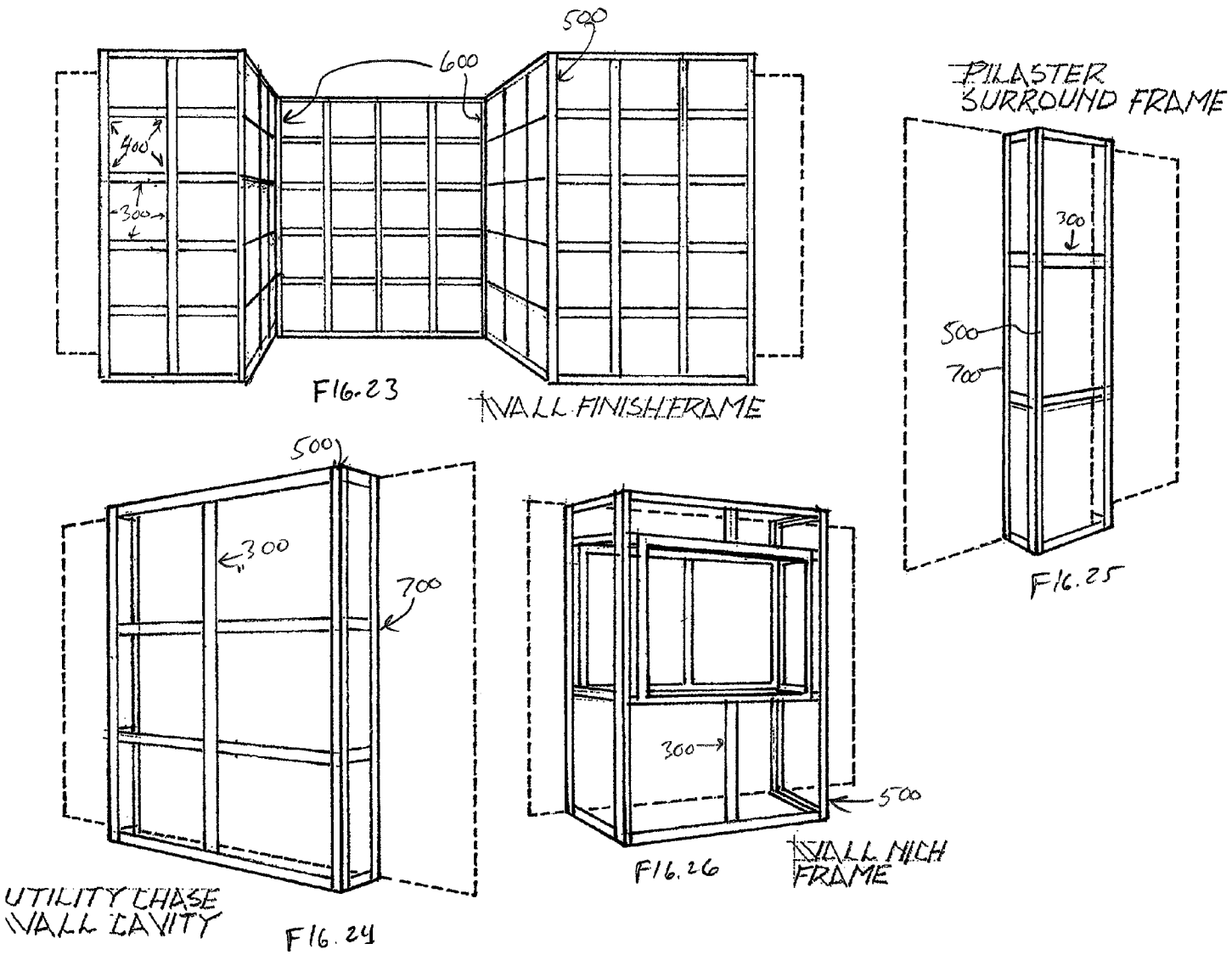
FIG. 23 is a perspective view of a wall finish frame that can be formed with any of the embodiments of the main rail and associated components illustrated in FIGS. 1-17.
FIG. 24 is a perspective view of a utility chase wall cavity frame that can be formed with any of the embodiments of the main rail and associated components illustrated in FIGS. 1-17.
FIG. 25 is a perspective view of a pilaster surround frame that can be formed with any of the embodiments of the main rail and associated components illustrated in FIGS. 1-17.
FIG. 26 is a perspective view of a wall niche frame that can be formed of any of the embodiments of the main rail and associated components illustrated in FIGS. 1-17.
Figures 27, 28, 29, 30:
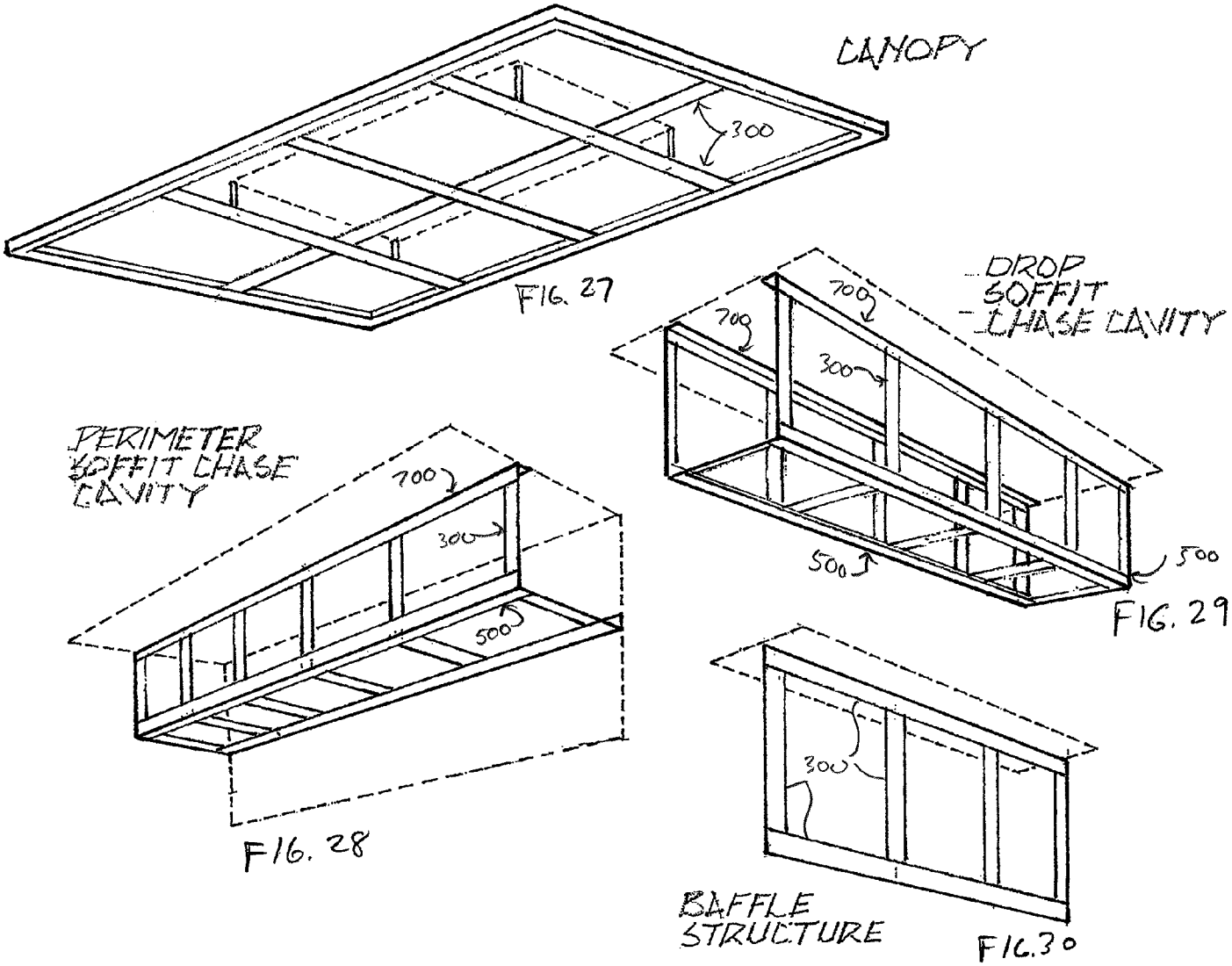
FIG. 27 is a perspective view of a frame for a canopy that can be formed with the main rail in any associated components illustrated in FIGS. 1-17.
FIG. 28 is a perspective view of a perimeter soffit chase frame which can be formed with any of the embodiments of the main rail and associated components illustrated in FIGS. 1-17.
FIG. 29 is a perspective view of a drop soffit chase cavity frame which can be formed with any of the embodiments of the main rail and associated components of FIGS. 1-17.
FIG. 30 is a perspective view of a baffle structure which can be formed with any of the embodiments of the main rail and associated components illustrated in FIGS. 1-17.

FIG. 17 illustrates a perspective view of an alternative embodiment of a main rail junction 400", which can also be configured to receive removable rail inserts 1300 noted above. In some embodiments, the modular wall panel system can include an alternative embodiment of the main rail 400".

In some embodiments, the features described above in relation to a particular component or type of rail can be applied to other components of the modular wall panel system 100 including different types or embodiments of rails. In addition, various components described above may be able to be combined in additional orientations or arrangements which may not have been illustrated or discussed.

FIGS. 18-37 illustrate various different types of frames that can be formed using any embodiments of the main rail 300, 300', 300", main rail junctions 400, 400', 400", outside corner rails 500, 500', inside corner rails 600, 600', edge rails 700, 700', and rail inserts 1300, 1300' and associated components described above, although only the reference numerals 300, 400, 500, 600, 700, etc are used below in some references to the embodiments of FIGS. 18-37 for brevity.

Figures 31, 32:
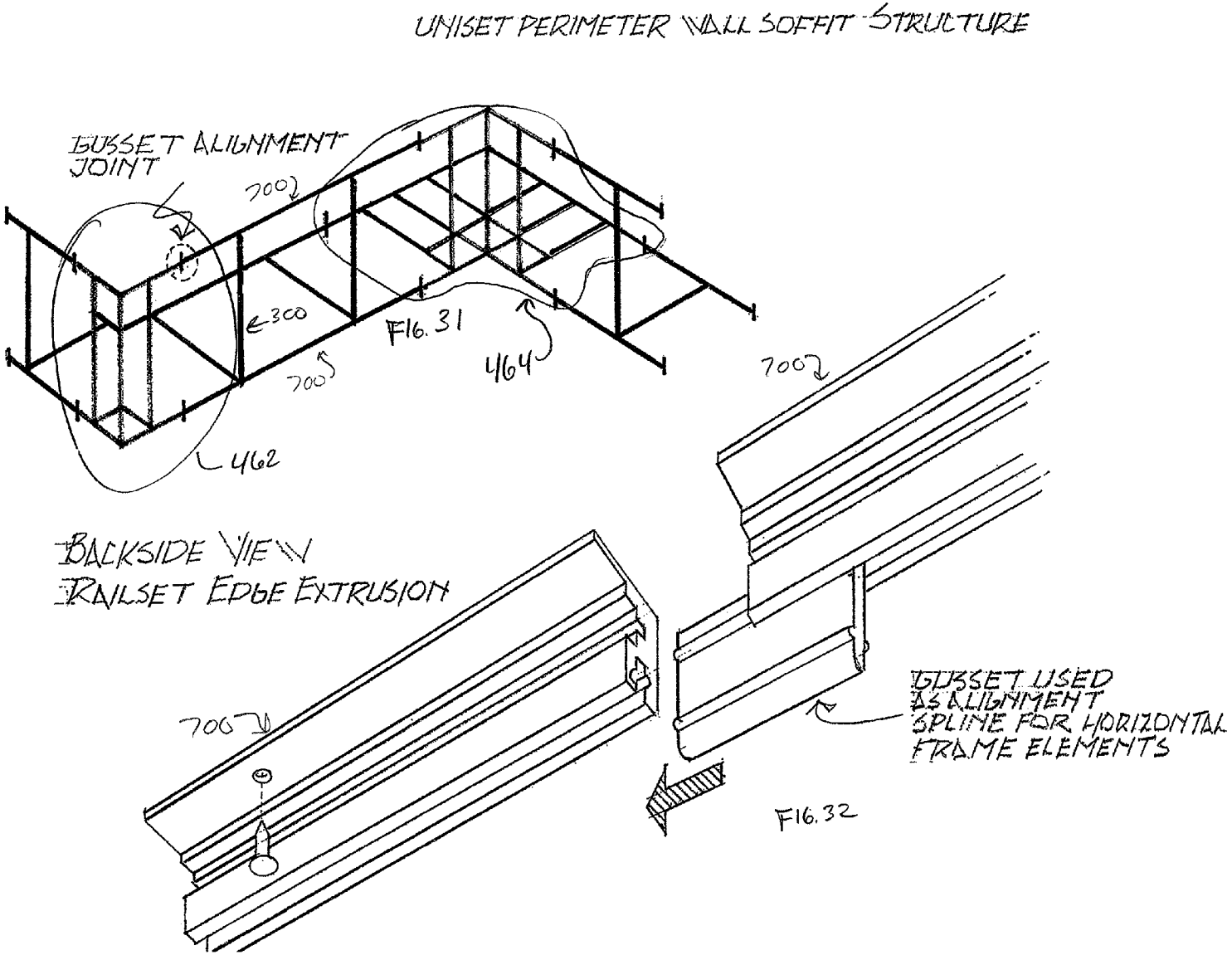
FIG. 31 is a perspective view of a perimeter wall soffit structure which can include prefabricated corner and end sections which can be formed with any of the embodiments of the main rail and associated components illustrated in FIGS. 1-17.
FIG. 32 is a perspective, exploded view of a butt joint used in the frame of FIG. 31.
Figure 33:
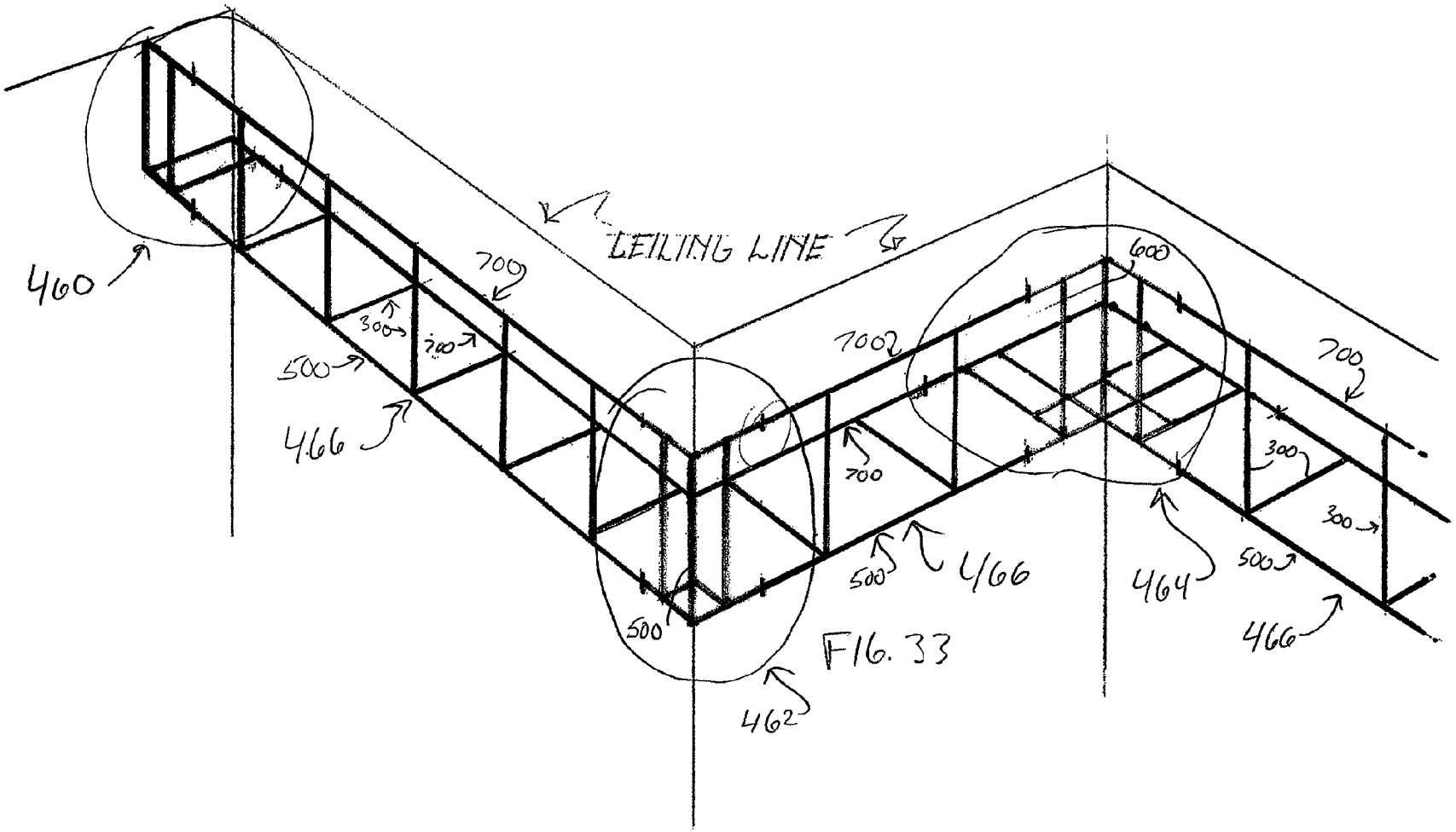
FIG. 33 is a perspective view of a perimeter wall soffit structure frame identifying various optional prefabricated portions.
Figure 36:
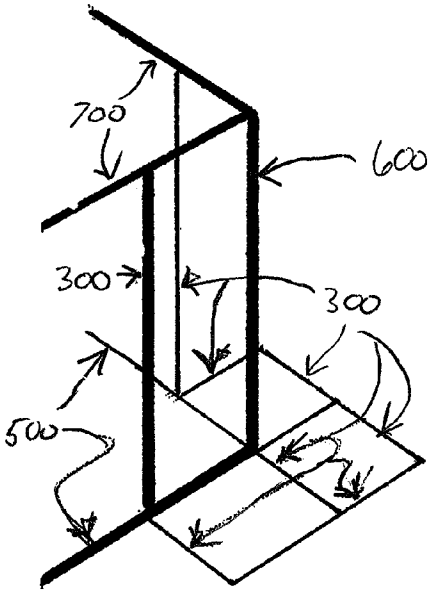
FIG. 36 is a perspective view of a prefabricated outside corner structure that can be used in the frame of FIG. 33.
Figure 35:
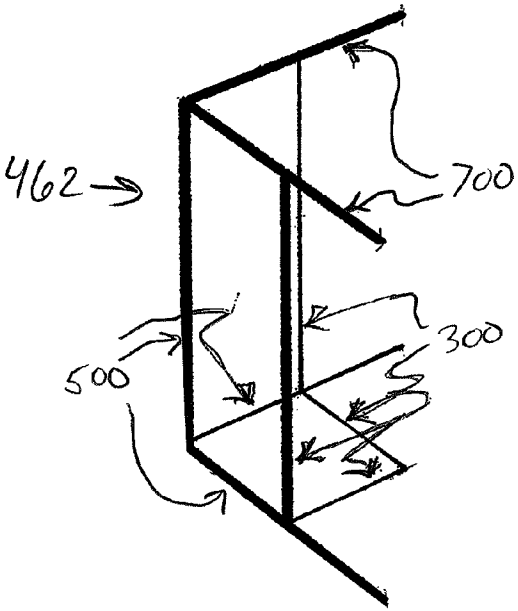
FIG. 35 is a perspective view of a prefabricated outside corner structure that can be used with the frame of FIG. 33.
Figure 34:
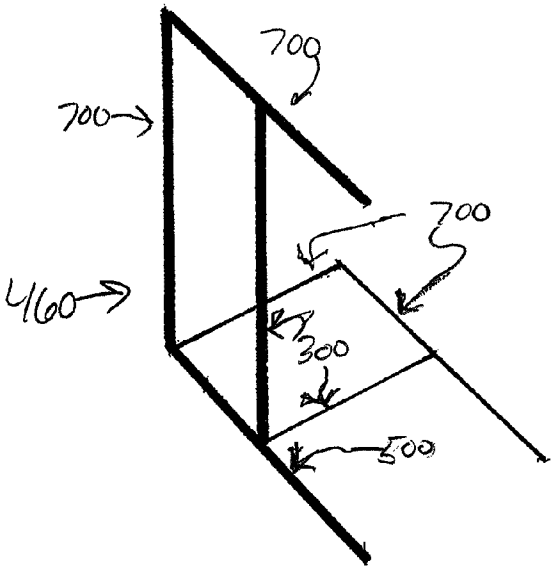
FIG. 34 is a perspective view of a prefabricated and structure portion that can be used in conjunction with thief frame of FIG. 33.
Figure 37:
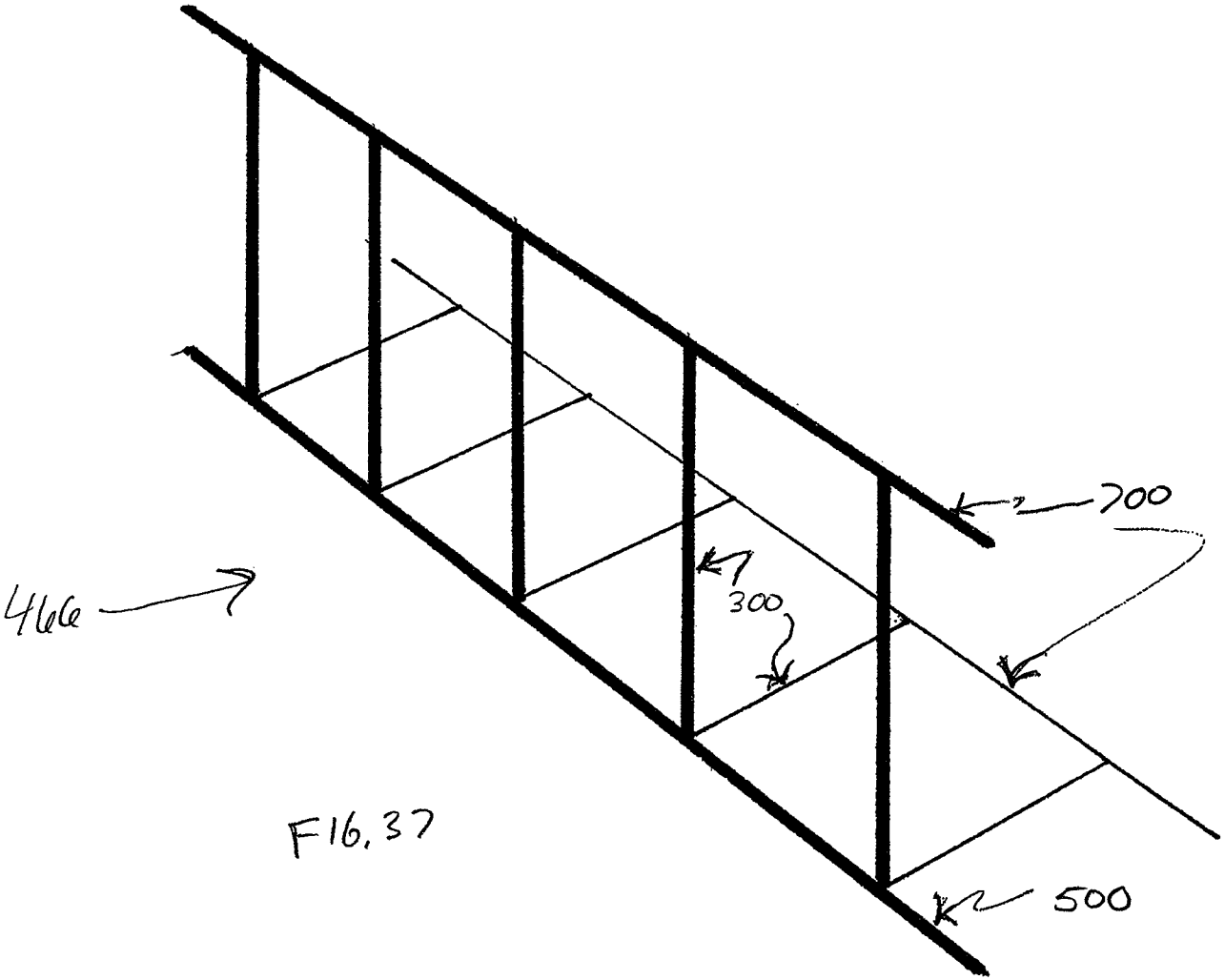
FIG. 37 is a perspective view of a prefabricated rail set structure that can be used with the frame of FIG. 33.

FIGS. 31-37 further illustrate framing assemblies which can benefit from the use of some prefabricated portions. For example, as shown in FIGS. 31 and 33, a perimeter wall soffit structure can include one or more of any of the following: prefabricated end structure 460, prefabricated outside corner structure 462, prefabricated inside corner structure 464, and prefabricated rail set 466. Additionally, FIG. 32 illustrates a butt joint that can be used to connect the various prefabricated pieces illustrated in FIGS. 31 and 33-37 as well as to the various embodiments of the other structures, prefabricated or not, such as the main rail 400, 400', 400", edge rails 700, etc.

FIGS. 34-37 illustrate, schematically, optional configurations of the end structure 460, outside corner structure 462, inside corner structure 464, and rail sets 466 that can be used in the frame configuration illustrated in FIGS. 31 and 33, and including optional dimensions that could be used in an example of an installation configuration. Other dimensions can also be used.

As used herein, the term "wall" refers to any service that defines a boundary. Thus, in the figures described herein, various structures are described including, for example, but without limitation, façades, room partitions, casework structures, room enclosures, Chase cavity partitions, merchandise fixtures, wall finish frames, plaster surrounds, utility Chase wall cavities, wall niches, canopies, ceilings, perimeter soffit Chase cavities, drop soffit Chase cavities, baffled structures, etc. Any (external or internal) surface of any of the above noted structures are considered to be a "wall" as that term is used in the present specification.

In some embodiments, various portions of the modular wall panel system can be manufactured from any suitable material or combination of materials which may include, for example, metals and alloys such as for example, aluminum, steel, stainless steel, titanium, iron, alloy, non-metal materials such as for example, polymers, carbon, ceramics and other non-metallic materials such as plastic, thermoplastic, thermoset, acrylonitrile butadiene styrene, polycarbonate acetal, acrylic, nylon, polybutylene terephthalate, polyester liquid crystal polymer, polypropylene, polycarbonate, polyimide, polythelene, carbon fiber, or combinations thereof.

In some embodiments, portions of the modular wall panel system can be formed via extrusion, machining, injection molding, casting, thermoforming, compression molding, blow molding, transfer molding, three dimensional printing or any combination thereof. In one embodiment, the material may be reinforced with glass or carbon fibers. In some embodiments, different portions of the modular wall panel system can be affixed to one another using securing means which may include, for example fasteners, clips, adhesive, cement, welding, press fits, interference fits, friction, clamps, etc.

What is claimed is:

1. A wall, comprising:

a frame having at least a panel engaging portion comprising a generally planar mounting surface, the panel engaging portion including first and second lateral sides on opposite sides of a center of the generally planar mounting surface, at least one of the first and second lateral sides of the generally planar mounting surface comprising at least one of knurls and raised ridges;

the frame further comprising at least first and second channels, each channel comprising side walls extending generally parallel to the generally planar mounting surface, the first and second channels facing away from each other, and wherein at least one sidewall of each of the first and second channels includes a longitudinally extending recess; and a planar member engaged with the at least one of the knurls and raised ridges, and connected with a fastener to and at least partially supported by the frame.

2. A wall according to claim 1, wherein a first side wall of the first channel and a first sidewall of the second channel are coplanar.

3. A wall according to claim 2, wherein the first sidewall of the first channel and the first sidewall of the second channel include exterior surfaces, the exterior surfaces forming portions of the generally planar mounting surface.

4. A wall according to claim 3, wherein the exterior surfaces are spaced apart with a third channel formed therebetween, the third channel extending generally parallel to the first and second channels.

5. A wall according to claim 3, wherein the generally planar mounting surface includes a central portion disposed between the exterior surfaces so as to form a single, continuous, generally planar mounting surface.

6. A wall according to claim 1, wherein both of the first and second channels include first and second sidewalls, and wherein both of the first and second sidewalls of the first and second channels include juxtaposed recesses configured to provide engagement with an enlarged portion of a member extending into the first and second channels.

7. A wall according to claim 1, wherein the frame comprises at least a first rail defining the generally planar mounting surface and a second rail extending generally perpendicular to the first rail, the second rail including a second generally planar mounting surface arranged so as to be generally coplanar with the generally planar mounting surface of the first rail, the second rail coupled to the first rail with a bracket contacting only sides of the first and second rails opposite the generally planar mounting surface.

8. A wall, comprising:

a first frame rail connected to a second frame rail in a perpendicular relationship;

the first frame rail extending along a first longitudinal direction, the first frame rail comprising a first front side and a first back side, the first back side comprising a first channel extending longitudinally along a central portion of the first back side, and first left and right side portions extending parallel to the first channel, the first channel being recessed inwardly from the first left and right side portions;

the second frame rail extending along a second longitudinal direction perpendicular to the first longitudinal direction, the second frame rail comprising a second front side and a second back side, the second back side comprising a second channel extending longitudinally along a central portion of the second back side, and second left and right side portions extending parallel to the second channel, the second channel being recessed inwardly from the second left and right side portions;

a bracket connecting the first and second frame rails, the bracket extending longitudinally along a length and laterally along a width transverse to the length, the bracket comprising a first channel engaging portion, a second channel engaging portion and a first recessed portion arranged serially along the length of the bracket with the first recessed portion disposed between the first and second channel engaging portions, the width of the bracket being uniform over a portion of the bracket defined by the first channel engaging portion and the second channel engaging portion, the first channel engaging portion being disposed in and connected to the first channel, the second channel engaging portion being disposed in and connected to the second channel, the first recessed portion extending over the second left side portion of the second frame rail.

9. A wall according to claim 8, wherein the first and second channel engaging portions have first and second lengths, respectively, along the longitudinal direction of the bracket, the first and second lengths sized to fit within a width of the first channel, wherein the width of the first channel is the same as a width of the second channel.

10. A wall according to claim 8, wherein the first and second channel engaging portions of the bracket share a first plane.

11. A wall according to claim 8, wherein the first recessed portion follows the contours of the second left side portion of the second frame rail.

12. A wall according to claim 8 additionally comprising a planar member extending over the front sides of the first and second frame rails and supported by at least one of the first and second frame rails.

13. A wall according to claim 8, wherein the bracket further comprises a second recessed portion extending over the second right side portion of the second frame rail.

14. A wall according to claim 13, wherein the first and second recessed portions share a second plane.

15. A wall according to claim 14, wherein the bracket further comprises a third channel engaging portion, the second recessed portion being disposed between the second and third channel engaging portions, wherein the first, second, and third channel engaging portions share the first plane.

16. A wall according to claim 15 additionally comprising a third frame rail extending perpendicularly to the second frame rail, wherein the third channel engaging portion is engaged with a channel on a back side of the third frame rail, the first and third frame rails being aligned longitudinally.

17. A wall according to claim 15, wherein the third channel engaging portion is disposed serially relative to the first and second channel engaging portions with the second engaging portion disposed between the first and third channel engaging portions, the width of the bracket being uniform over the first, second, and third channel engaging portions.

18. A wall according to claim 17, wherein the first, second, and third channel engaging portions have first, second, and third lengths along the longitudinal direction of the bracket, the first, second, and third lengths sized to fit within a width of the first channel, wherein the width of the first channel is the same as a width of the second channel.

19. A wall according to claim 13, wherein the second recessed portion is disposed serially along the length of the bracket, relative to the first channel engaging portion, the second channel engaging portion and the first recessed portion, the width of the bracket being uniform along the first channel engaging portion, the second channel engaging portion, the first recessed portion, and the second recessed portion.

* * * * *